US006127108A

United States Patent [19]

Kita et al.

[11] Patent Number: 6,127,108

[45] Date of Patent: Oct. 3, 2000

[54] SILVER HALIDE COLOR PHOTOGRAPHIC LIGHT SENSITIVE MATERIAL

[75] Inventors: Hiroshi Kita, Hino; Kazuhiro Murai, Odawara, both of Japan

[73] Assignee: Konica Corporation, Japan

[21] Appl. No.: 08/899,761

[22] Filed: Jul. 24, 1997

[30] Foreign Application Priority Data

Aug. 14, 1996 [JP] Japan ..... 8-214785

[51] Int. Cl.[7] ..... G03C 7/305

[52] U.S. Cl. ..... 430/546; 430/551; 430/554; 430/555; 430/613; 430/614

[58] Field of Search ..... 430/613, 614, 430/546, 551, 554, 555

[56] References Cited

U.S. PATENT DOCUMENTS

| | | | |
|---|---|---|---|
| 4,463,085 | 7/1984 | Mitsui et al. . | |
| 4,585,728 | 4/1986 | Furutachi et al. . | |
| 5,958,663 | 9/1999 | Jeganathan | 430/551 |

FOREIGN PATENT DOCUMENTS

| | | |
|---|---|---|
| 5-241287 | 9/1993 | Japan . |
| 8-297343 | 4/1995 | Japan . |
| 8-297344 | 4/1995 | Japan . |
| 5-241283 | 9/1996 | Japan . |
| 9-77729 | 3/1997 | Japan . |

OTHER PUBLICATIONS

European Seach Report (Partial) #EP 97 11 3829 (5 pgs).
EPO Patent Abstracts of Japan, Publication #02262654 (1 pg).
EPO Patent Abstracts of Japan, Publication #62178258 (1 pg).
EPO Patent Abstracts of Japan, Publication #01223450 (1 pg).
EPO Patent Abstracts of Japan, Publication #62275250 (1 pg).

*Primary Examiner*—Janet Baxter
*Assistant Examiner*—Amanda C. Walke
*Attorney, Agent, or Firm*—Jordan B. Bierman; Bierman, Muserlian and Lucas

[57] ABSTRACT

A silver halide color photographic material wherein a cyan dye image density reduction is prevented in time of bleach fixing processing or bleach fixing, and its processing method by incorporating an oil soluble organic basic compound in the silver halide color photographic material. The compound oil soluble organic basic compound is represented by Formulas (I) to (V) defined in the specification.

15 Claims, No Drawings

SILVER HALIDE COLOR PHOTOGRAPHIC LIGHT SENSITIVE MATERIAL

BACKGROUND OF THE INVENTION

The present invention relates to a silver halide color photographic light-sensitive material and its processing method. Particularly, the silver halide color photographic light-sensitive material wherein a cyan dye loss in a low replenishing rapid processing is improved and its processing method.

In addition, it relates to a silver halide color photographic light-sensitive material wherein light fastness and heat resistance of a dye which forms an image is improved and stain in a non-colored portion is reduced without damaging coloring and the stability of the dispersion solution coated on aforesaid photographic light-sensitive material.

Ordinarily, in order to obtain a color image by processing a silver halide color photographic light-sensitive material (hereinafter, referred to as "color light-sensitive material") which has been imagewise exposure, metallic silver which is generated after the color developing process is desilvered. Successively, processing steps such as washing and stabilizing are provided. The desilvering step is composed of the bleaching and the fixing step or the bleach-fixing step integrally provided.

Recently, for the purpose of resource saving and cost reduction, increasing of the speed of the bleach-fixing processing is demanded. In addition, from the viewpoint of reducing environmental contamination, reduction of processing effluent, i.e., reduction of the amount of the bleach fixing replenishing amount is strongly demanded. However, it has been discovered that, if reduction of the amount of effluent is reduction of the amount of replenishing, the following problems occur.

Namely, due to extension of staying time of the bleach-fixing solution, density of silver ion accumulating in a solution due to desilvering reaction in increased and mixing ratio of a color developing solution is increased. Accordingly, deterioration of the bleach-fixing solution due to the change of $Fe^{III}$ to $Fe^{II}$ in an aminopolycarbonic acid complex type bleacher represented by ethylenediamine tetraacetic acid ferric complex, propylenediamine tetraacetic acid ferric complex and diethylene triamine pentaacetic acid ferric complex. In addition, it has been found that, as a means for reducing replenishment, the density of aforesaid bleacher is increased, $Fe^{II}$ becomes easy to occur.

The above-mentioned deterioration of bleach-fixing solution retards desilvering and causes poor desilvering. In addition, $Fe^{II}$ which has been increased reduces a cyan dye to a colorless leuco dye. Accordingly, an important problem occurs that cyan does not sufficiently colored (so-called, cyan dye loss occurs).

For countering the deterioration of aforesaid bleach-fixing solution, various approaches has been made from the viewpoint of processing solution. For example, Japanese Patent Publication Open to Public Inspection (hereinafter, Japanese Patent O.P.I. Publication) Nos. 1-244453 and 1-244454 disclose technologies to prevent the generation of $Fe^{II}$ complex and Japanese Patent O.P.I. Publication No. 1-161067 discloses improvement of poor desilvering or a technology to inhibit the generation of a leuco cyan dye.

However, the above-mentioned technologies were insufficient in terms of improving poor desilvering and dye loss, if there is a fluctuation of processing amount in a system in which increasing of processing and reduction of replenishing could be realized. Accordingly, the problem of dye loss under low replenishment processing in which processing effluent substantially does not occur from the viewpoint of environment protection and specially under low pH has come to be more and more serious.

On the other hand, together with proliferation of a small-sized processing equipment, called "mini-lab", increasing of the speed of processing has come to be strongly demanded. Therefore, demand for reduction of bleaching or bleach-fixing step has been increased. However, ethylenediamine tetraacetic acid ferric salt which has been used as a bleacher heretofore provides weak oxidation force so that sufficient requirements could not be satisfied. Therefore, a bleacher containing 1,3-diaminopropane tetraacetic ferric salt which has no problem in terms of environment conservation, toxicity and handling has been developed and put into practical use.

However, aforesaid bleacher provides too strong oxidation force. Therefore, a color developing agent carried over to a bleaching bath or a bleach-fixing bath is also oxidized. As a result, in an unexposed portion too, a coloring dye is generated so that stain occurs. This phenomenon is called as a bleaching fogging. As means for reducing aforesaid bleaching fogging, a technology to use a specific magenta coupler and an aniline type basic compound in combination disclosed in Japanese Patent O.P.I. Publication No. 58-105147, a technology to use a specific magenta coupler and a 2,2,6,6-tetraalkylpyperidine type compound (so-called HALS compound) in combination disclosed in Japanese Patent O.P.I. Publication No. 58-102231 and a technology to add an ordinary basic compound in a red sensitive silver halide light-sensitive layer disclosed in Japanese Patent O.P.I. Publication No. 3-1137 are known.

In the above-mentioned technologies, effects to reduce bleaching fogging are observed to some extent. However, due to the basic compound, dispersion damage occurs when a dispersion solution containing a coupler and silver halide is prepared. Accordingly, a stable dispersion solution could not be obtained. In addition, stability of aforesaid dispersed product after specific time is extremely deteriorated. Further, coloring properties (the maximum coloring density, sensitivity and gradation) are noticeably deteriorated.

On the other hand, in addition to a technologies to improve the above-mentioned bleach fogging, technologies to incorporate basic compounds in light-sensitive materials are known. For example, technologies to improve light-fastness of a magenta color image by using a cyclic amines together with a pyrazolotriazole based magenta coupler disclosed in Japanese Patent O.P.I. Publication Nos. 61-72246 and 61-189539 and technologies to improve light fastness of a cyan color image by the use of a chained secondary and tertiary amines having a steric hindrance group disclosed in Japanese Patent O.P.I. Publication No.1-223450. In such cases, it is sure that fastness of a dye is improved to some extent. However, it has been understood that several inconvenience deriving from basic compounds in the same manner as in the above-mentioned cases has occurred.

Namely, to incorporate a basic compound in a light-sensitive material provides effects in terms of reducing bleach fogging and color image stiffness. However, on the contrary, critical problems that coloring property of the light-sensitive material is noticeably reduced and stability of the dispersion product is noticeably deteriorated occur. Therefore, it was extremely difficult to add the basic compound in a light-sensitive material.

SUMMARY OF THE INVENTION

An object of the present invention is to provide a silver halide color photographic light-sensitive material wherein dye loss is improved and high coloring density can be obtained even under rapid and low replenishing processing and its processing method.

In addition, another object of the present invention is to maintain the improvement effects that the above-mentioned basic compound has and to discover novel compounds for photographic light-sensitive material which does not have the shortcoming thereof. Practically, to provide a silver halide color photographic light-sensitive material (a) excellent in terms of light fastness and heat resistance of a color image formed, wherein (b) stain in un-colored portion is reduced and (c) there is no deterioration in terms of coupler coloring property and stability of dispersion composition containing a coupler.

It has been found that the reduction of the cyan dye density in the bleach fixing step or the bleaching step (i.e., dye loss) is noticeably improved by adding an oil-soluble organic basic compound in a light-sensitive material in a small amount.

The invention and its embodiment are described.

(1) A silver halide color photographic light-sensitive material of the invention contains an oil-soluble organic basic compound whereby reduction of the cyan dye image density is prevented in case of processed by bleach-fixing or bleaching.

(2) A silver halide color photographic light-sensitive material of the invention contains an oil-soluble organic basic compound whose oil pH variation value (ΔpH) was +0.1 or more whereby reduction of the cyan dye image density was prevented in case of processed by bleach fixing or bleaching.

It is defined that the oil pH variation value={pH value of 1 wt % ethanol in terms of solute/water=8/2 (by volume) at 25° C.}—{pH value of a solution of ethanol/water=8/2 (volume ratio) at 25° C.}.

(3) The silver halide color photographic light-sensitive material described in the item (1) or (2) wherein the oil-soluble organic basic compound is incorporated in a red sensitive silver halide emulsion layer and at least one of adjoining layer.

(4) The silver halide color photographic light-sensitive material described in the item (1), (2) or (3) wherein the oil-soluble organic basic compound is represented by the following Formula (1), (II) or (III).

Formula (I)

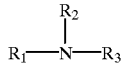

Formula (II)

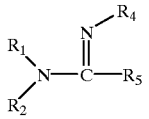

Formula (III)

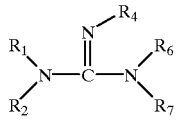

wherein $R_1$, $R_2$, $R_3$, $R_4$, $R_6$, and $R_7$ independently represent a hydrogen atom, an aliphatic group, an aromatic group, a hydroxyl group, an aliphatic oxy group, an aromatic oxy group or a heterocycle; $R_5$ represents a hydrogen atom, an aliphatic group, an aromatic group or a heterocycle: two of $R_1$ through $R_7$ which adjoin each other may be linked together for forming a ring in a molecule, provided that, in Formula (I), all of $R_1$, $R_2$ and $R_3$ and in (II), all of $R_1$, $R_2$, $R_4$ and $R_5$ and in (III), all of $R_1$, $R_2$, $R_4$, $R_6$ and $R_7$ are not a hydrogen atom concurrently.

(5) The silver halide color photographic light-sensitive material described in the item (1), (2) or (3) wherein the oil soluble organic basic compound is represented by the following Formula (IV).

Formula (IV)

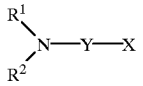

wherein $R^1$ and $R^2$ independently represent a hydrogen atom, an aliphatic group, an aromatic group, a hydroxyl group, an aliphatic oxy group, an aromatic oxy group or a heterocycle; X represents an electron attractive group of which Hammett's substituent constant σp value is 0.25 or more; Y represents an alkylene group in which the carbon number of the main chain is 1 through 4; and $R^1$ and $R^2$ may be linked together for forming a ring in a molecule.

(6) A method of processing a silver halide color photographic light-sensitive material by the use of a color developing solution not substantially containing benzyl alcohol, after imagewise exposing a silver halide color photographic light-sensitive material described in either of the item (1) through (5).

(7) The processing method of the silver halide color photographic light-sensitive material wherein the bleach-fixing solution used for aforesaid bleach fixing processing contains silver ion by 0.04 to 0.11 mol per litre of the bleach-fixing solution and, concurrently with this, the density of $Fe^{II}$ is 5–35% of the all amount of iron complex in time of conducting bleach fixing processing successively after the color developing processing after imagewise exposing the silver halide color photographic light-sensitive material described in either of the item (1) through (5).

(8) The processing method of the silver halide color photographic light-sensitive material described in either item (6) or (7) wherein pH of the bleach fixing is 5.0–6.5.

(9) The processing method of the silver halide color photographic light-sensitive material wherein bleach fixing processing is conducted for within 30 seconds or less when conducting aforesaid bleach-fixing processing, washing processing and/or stabilizing processing successively after the color developing processing after image wise exposure of the silver halide color photographic light-sensitive material containing the oil soluble organic basic compound whose oil pH variation value is +0.1 or more.

(10) The silver halide color photographic light-sensitive material containing a non-coloring property and water-insoluble compound represented by the following Formula (V).

Formula (V)

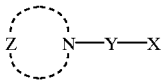

wherein X represents an electron attractive group of which Hammett's substituent constant σp value is 0.25 or more; Y represents an alkylene group in which the carbon number of the main chain is 1 through 4; Z represents a non-metallic atom group necessary for forming a 5–7 member non-aromatic heterocycle together with a nitrogen atom; When a nitrogen atom exists which can substitute on Z, aforesaid nitrogen atom is substituted with (—Y' —X'); X' represents the same as X and Y' represents the same as Y.; and X and X' and Y and Y' may be the same or different, provided that there is no basic amino group other than a basic skeleton of a non-aromatic heterocycle represented by

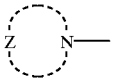

and the sum of the carbon number of the molecule is 14 or more.

(11) The silver halide color photographic light-sensitive material containing at least one kind of non-coloring and water-insoluble compound represented by the following Formulas (Va), (Vb), (Vc) or (Vd).

Formula (Va)

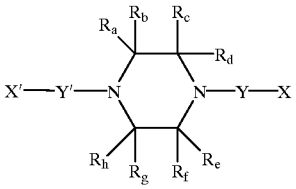

Formula (Vb)

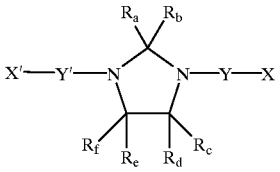

Formula (Vc)

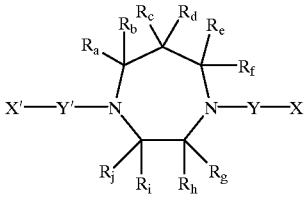

wherein X represent an electron attractive group of which Hammett's substituent constant σp value is 0.25 or more; Y represents an alkylene group in which the carbon number of the main chain is 1 through 4; X' represents the same as X, and Y' represents Y; X and X' and Y and Y' may be the same or different; $R_a$, $R_b$, $R_c$, $R_d$, $R_e$, $R_f$, $R_g$, $R_h$, $R_i$ and $R_j$ independently represents a hydrogen atom or an alkyl group; and the sum of the carbon number in a molecule is 14 or more.

Formula (Vd)

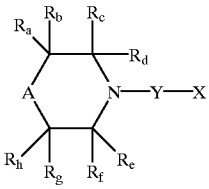

wherein X represents an electron attractive group of which Hammett's substituent constant σp value is 0.25 or more; Y represents an alkylene group in which the carbon number of the main chain is 1 through 4; A represents an oxygen atom, a sulfur atom, a methylene atom or a bond hand; $R_a$, $R_b$, $R_c$, $R_d$, $R_e$, $R_f$, $R_g$, $R_h$, $R_i$ and $R_j$ independently represents a hydrogen atom or an alkyl group; and the sum of the carbon number in a molecule is 14 or more.

(12) The silver halide color photographic light-sensitive material containing at least one kind of non-coloring and water-insoluble compound represented by the following Formula (Va-1), (Vd-1) or (Vd-2).

Formula (Va-1)

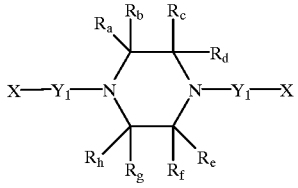

wherein X represents an electron attractive group of which Hammett's substituent constant σp value is 0.25 or more; $Y_1$ represents an alkylene group in which the carbon number of the main chain is 1 through 4; $R_a$, $R_b$, $R_c$, $R_d$, $R_e$, $R_f$, $R_g$, $R_h$, $R_i$ and $R_j$ independently represents a hydrogen atom or an alkyl group; and the sum of the carbon number in X and $Y_1$ is 12 or more.

Formula (Vd-1)

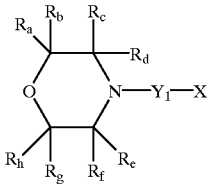

wherein X represents an electron attractive group of which Hammett's substituent constant σp value is 0.25 or more; $Y_1$ represents an alkylene group in which the carbon number of the main chain is 1 through 4; $R_a$, $R_b$, $R_c$, $R_d$, $R_e$, $R_f$, $R_g$, $R_h$, $R_i$ and $R_j$ independently represents a hydrogen atom or an alkyl group; and the sum of the carbon number in X and $Y_1$ is 12 or more.

Formula (Vd-2)

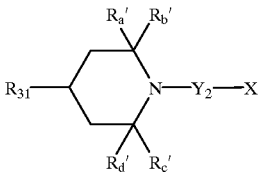

wherein X represents an electron attractive group of which Hammett's substituent constant σp value is 0.25 or more; $Y_2$ represents an alkylene group in which the carbon number of the main chain is 1 through 3: $R_a'$, $R_b'$, $R_c'$ and $R_d'$ independently represents an alkyl group; $R_{31}$ represents an acyloxy group, an acylamino group, a hydroxyl group or an alkyl group; and the sum of carbon number of X, $Y_2$, $R_{31}$, $R_a'$, $R_b'$, $R_c'$ and $R_d'$ is 12 or more.

(13) The silver halide color photographic light-sensitive material containing at least one kind of non-coloring and water-insoluble compound represented by the following Formula (Va-2).

Formula (Va-2)

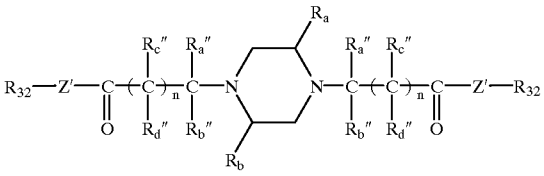

wherein $R_a$, $R_b$, $R_a''$, $R_b''$, $R_c''$ and $R_d''$ independently represents a hydrogen atom, or an alkyl group; Z' represents —O— or —N($R_{33}$)—; $R_{32}$ represents an alkyl group, an alkenyl group or an aryl group; $R_{33}$ represents a hydrogen atom, an alkyl group or an aryl group; n represents 0 or 1; and the sum of the carbon number of $R_a$, $R_b$, $R_a''$, $R_b''$, $R_c''$, $R_d''$, $R_{32}$ and $R_{33}$ is 20 or more.

DETAILED DISCLOSURE OF THE INVENTION

Hereinafter, the present invention will be detailed.

The theory of aforesaid effects is so far not found. However, it is considered that reduction reaction by means of $Fe^{II}$ in the cyan dye is effectively inhibited due to the existence of the basic compound in the vicinity of the cyan dye (in an oil phase in which the cyan dye exists). As a result, the dye loss is improved.

In the present invention, "oil soluble organic basic compound" is capable of being dissolved in a high boiling organic solvent (for example, dioctylphthalate, di-i-decylphthalate, tricresylphosphate, trioctylphosphate and 2,4-dinonylphenyl) and also capable of forming a salt with mineral acid such as hydrochloric acid, sulfuric acid and nitric acid. Preferably, it can be dissolved by 1 g or more in 100 cc of ethylacetic acid at 40° C. More preferably, pH value at 1 wt % ethanol/water=8/2 (by volume) at 25° C. is higher than pH value of ethanol/water=8/2 (by volume) at 25° C. by 0.1 or more. It can be dissolved in 100 cc of ethylacetic acid at 40° C. by 5 g or more. Specifically, preferably, the above-mentioned oil pH variation value is 2 or more, and it can be dissolved in 100 cc of ethylacetic acid at 40° C. by 10 g or more.

The oil soluble organic basic compounds of the present invention are preferably contained by the above-mentioned Formulas (I), (II), (III) or (IV).

In Formulas (I) through (III), as an aliphatic group represented by $R_1$ through $R_7$ include straight-chained, branched-chained and cyclic alkyl group (for example, butyl, dodecyl, 2-ethylhexyl, t-butyl, cyclopentyl and cyclohexyl group), straight-chained, branched-chained and cyclic alkenyl group (for example, propenyl, 1-methyl-2-hexenyl and 2-cyclohexenyl).

As an aromatic group represented by $R_1$ through $R_7$, aryl groups such as a phenyl group and a naphtyl group (for example, a 1-naphtyl group and a 2-naphtyl group). As a heterocycle, 5 or 6 member heterocycle which may be condensed (for example, 2-imidazolyl, 2-furyl, 2-tetrahydrofuryl, 3-pyrazolyl, 1,4-dioxine and 4-pyridyl).

As an aliphatic group of an aliphatic oxy group represented by $R_1$ through $R_7$ are the same as those in the above-mentioned group. As an aromatic group in an aromatic oxy group are the same as those in the above-mentioned aromatic group.

Each group represented by aforesaid $R_1$ through $R_7$ may further has a substituent. As aforesaid substituent, an aliphatic group, an aromatic group, a hydroxyl group, a carboxyl group, a sulfo group (including salt and ester), a phosphoric acid group (including salt and ester), a nitro group, a cyano group, an acylamino group, an acyloxy group, a carbamoyl group, an aliphatic oxycarbonyl group, an aromatic oxycarbonyl group, an acyl group, a sulfonamide group, a sulfamoyl group, a sulfonyl group, a sulfinyl group, a phosphonyl group, a mercapto group, an aliphatic oxy group, an aromatic oxy group, a heterocyclic oxy group, an aliphatic thio group, an aromatic thio group, a heterocyclic thio group and a halogen atoms are cited.

Each group adjoining in $R_1$ through $R_7$ may form a ring in a molecule by combining each other. Practically, $R_1$ and $R_2$, $R_1$ and $R_4$, $R_1$ and $R_5$, $R_1$ and $R_6$, and $R_4$ and $R_5$ independently be linked together for forming 3-member through 10-member heterocycle.

The sum of the carbon number of a compound represented by Formulas (I) through (III) is preferably 8 through 72. It is more preferable to be 12 through 60. It is the most preferable to be 16 through 54.

Among Formulas (I) through (III), the preferable is a compound represented by Formula (I). In addition, among Formula (I), compounds represented by the following Formulas (I-1) and (I-2) are preferable.

Formula (I-1)

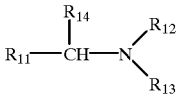

wherein, $R_{11}$ represents an aliphatic group, an aromatic group, a heterocycle, an aliphatic oxy group or an aromatic oxy group. $R_{12}$ and $R_{13}$ independently represents a hydrogen atom, a hydroxyl group or a —CH($R_{14}$)$R_{15}$ group; $R_{14}$ represents a hydrogen atom or a an aliphatic group; $R_{11}$ and $R_{14}$ may be linked together for forming a ring, provided that the sum of the carbon number of $R_{11}$ through $R_{14}$ is 11 through 59.

Formula (I-2)

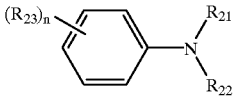

wherein $R_{21}$ and $R_{22}$ independently represent a hydrogen atom, a hydroxyl group, an aliphatic group, an aromatic group, an aliphatic oxy group or an aromatic oxy group: $R_{23}$ represents an aliphatic group, a nitro group, a cyano group or a halogen atom; n represents an integer of 0 through 5; when n is 2 or more, plural $R_{23}$ may the same or different, provided that the sum of the carbon number in $R_{21}$ through $R_{23}$ is 6 through 54.

As an aliphatic group, an aromatic group, an aliphatic oxy group, an aromatic oxy group represented by the above-mentioned $R_{11}$, $R_{21}$ and $R_{22}$, the same as those represented by the above-mentioned $R_1$ through $R_7$. A heterocycle represented by $R_{11}$ are the same as heterocycles represented by $R_1$ through $R_7$. An aliphatic group represented by $R_{23}$ is the same as those represented by the above-mentioned $R_1$ through $R_7$.

In Formula (I-1), the preferable substituent represented by $R_{11}$, an aliphatic group or an aromatic group. In Formula (I-2), the preferable substituents represented by $R_{21}$ and $R_{22}$ are an aliphatic group and a hydrogen atom.

In Formula (I-1), the sum of the carbon numbers of $R_{11}$ through $R_{14}$ is preferably 15 through 53. In Formula (I-2), the sum of the carbon number of $R_{21}$ through $R_{23}$ is more preferably 10 through 48.

In Formula (IV), an aliphatic group, an aromatic group, an aliphatic oxy group, an aromatic oxy group and a heterocycle represented by $R^1$ and $R^2$ represent the same groups as the aliphatic group, an aromatic group, an aliphatic oxy group, an aromatic oxy group and a heterocycle explained in $R_1$ through $R_4$ and $R_6$ of the above-mentioned Formula (I) through (III).

In case that $R^1$ and $R^2$ may be linked together for forming an imidazolidine group, a pyperadine group and a homopyperadine ring, two nitrogen atoms may concurrently be substituted with —Y—X.

As an electron attractive group of which Hammett's substituent constant σp value represented by X is 0.25 or more, those whose σp value is 0.25 or more among those described in "Chemical Region, extra number", No. 122, pp. 96–103, in 1979 (published by Nanko-Do), "Lange's Handbook of Chemistry" 12th edition, in 1979 (McGraw-Hill) edited by J. A. Dean and "Chemical Reviews" Volume 91, pp. 165–195 (in 1991). Typically, a nitro group (0.78), a cyano group (0.66), a carboxyl group (0.45), an acetyl group (0.50), a trifluoromethyl group (0.54), a trichloromethyl group (0.33), a benzoyl group (0.43), an acetyloxy group (0.31), a methanesulfonyl group (0.72), a methansulfinyl group (0.49), a benzenesulfonyl group (0.70), a carbamoyl group (0.36), a methoxycarbonyl group (0.45), an ethoxycarbonyl group (0.45), a phenoxycarbonyl group (0.44), a methanesulfonyloxy group (0.36), a pyrazolyl group (0.37) and a dimethoxyphosphoryl group (0.57) are cited. Of such substituents, those in which an alkyl group or an aryl group are substituted (for example, an acetyl group, a benzoyl group, a methoxycarbonyl group and a phenoxycarbonyl group) may further have a substituent. For example, the following substituents are cited:

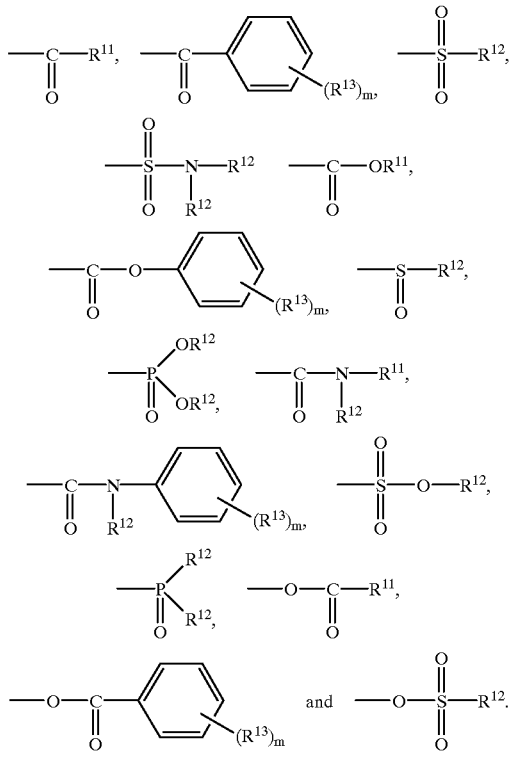

In the formulas $R^{11}$ represents a straight chained, branched or a cyclic alkyl group; $R^{12}$ represents a hydrogen atom, an aryl group or $R^{11}$; m represents an integer of 0 through 5; $R^{13}$ represents a nitro group, a cyano group, a hydroxyl group, an alkoxy group, an aryloxy group, an acyl group, an acyloxy group, an acylamino group, a sulfonamide group, a carbamoyl group, a sulfamoyl group, a sulfonyl group, a sulfinyl group, an alkoxycarbonyl group, an aryloxycarbonyl group, a sulfonyloxy group, a halogen atom, an aryl group, an alkyl thio group, an aryl thio group, an alkenyl group or $R^{11}$; and the alkyl group represented by $R^{11}$ may be substituted by a substituent cited in $R^{13}$.

The preferable examples are cited below.

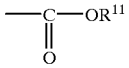

and

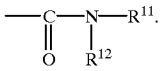

$R^{11}$ represents a straight chained, branched or a cyclic alkyl group, in the Formulas.

As an alkylene group whose carbon number in the main chain represented by Y is 1 to 4, practically the following Formula can be represented:

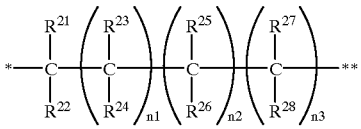

wherein $R^{21}$ through $R^{23}$ represents a hydrogen atom or substituents explained by the above-mentioned $R^{13}$; $n_1$, $n_2$ and $n_3$ independently represent 0 or 1. In the formulas, * represents a side which substitutes with a nitrogen atom, and ** represents a side which substitutes with X.

Hereinafter, practical examples of the oil-soluble organic compounds of the present invention (the compound of the present invention) are cited.

1

$C_{12}H_{25}NH_2$

2

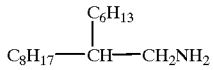

3

$C_8H_{17}CH{=}CH(CH_2)_8NH_2$

4

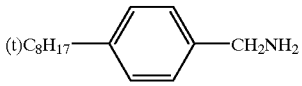

5

$C_{17}H_{35}CONHCH_2CH_2NH_2$

6

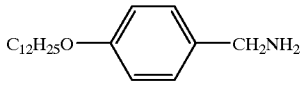

7

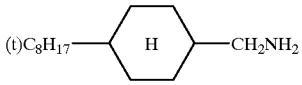

8

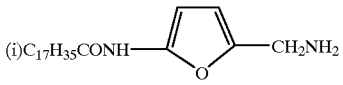

9

$C_{14}H_{29}OCH_2NH_2$

10

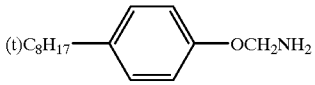

11

$C_{10}H_{21}CH{=}CHCH_2NH_2$

-continued

12

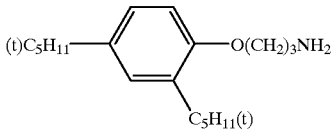

13

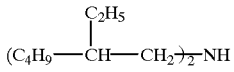

14

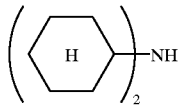

15

$[C_8H_{17}CH{=}CH{-}(CH_2)_8]_2NH$

16

$(C_{11}H_{23}COOCH_2CH_2)_2NH$

17

$(C_8H_{17}CH{=}CHCH_2)_2NH$

18

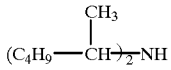

19

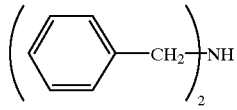

20

$(C_{12}H_{25}OCH_2)_2NH$

21

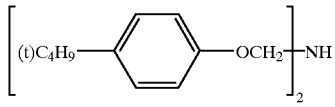

22

$C_{12}H_{25}NHC_3H_7(i)$

23

$C_{12}H_{25}NHC_4H_9$

24

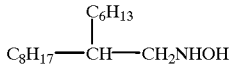

25

$(C_4H_9)_3N$

26

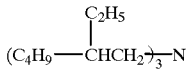

27

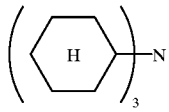

28

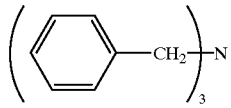

29

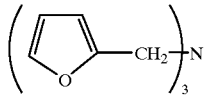

-continued
30 $(C_6H_{13}OCH_2CH_2)_3N$
31 $(C_8H_{17}OCH_2)_3N$
32 $(C_{11}H_{23}COOCH_2CH_2)_3N$
33
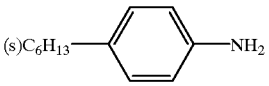
34
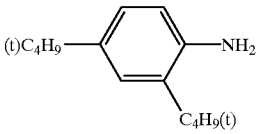
35
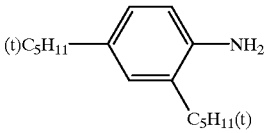
36
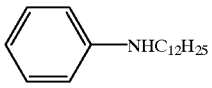
37
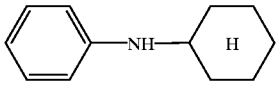
38
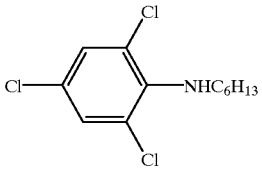
39
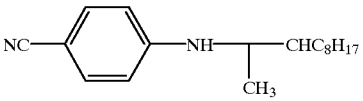
40
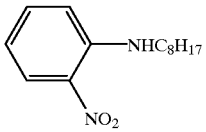
41
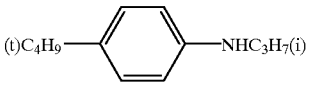
42
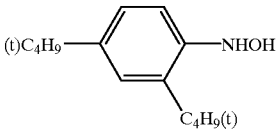
43
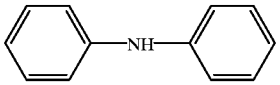
-continued
44
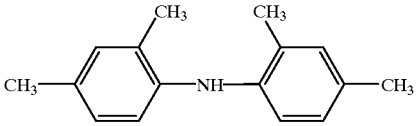
45
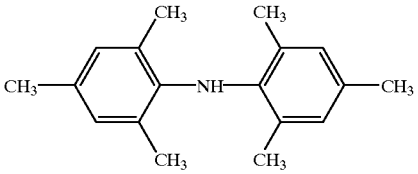
46
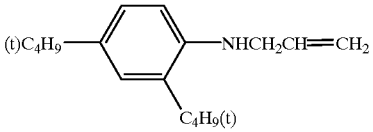
47
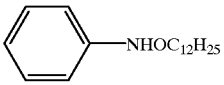
48
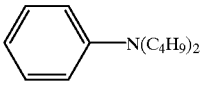
49
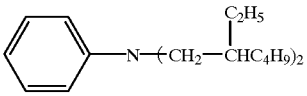
50
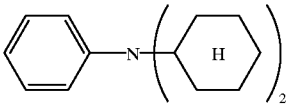
51
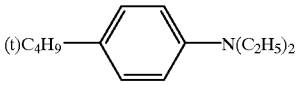
52
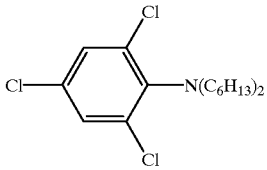
53
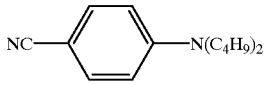
54
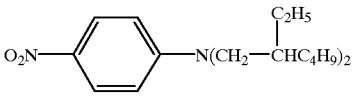
55
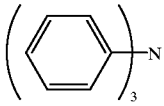

-continued
56
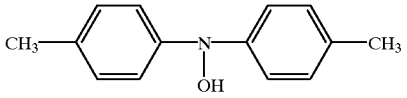
57
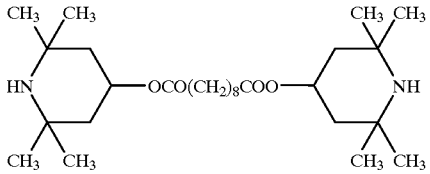
58
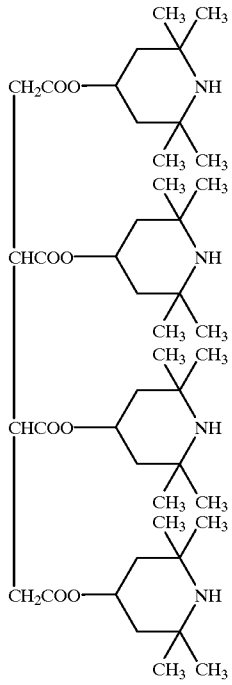
59
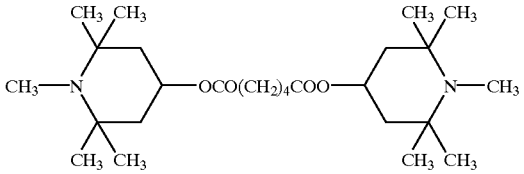
60
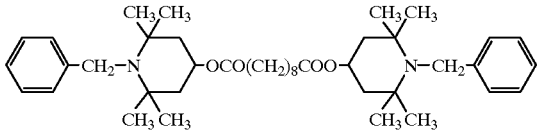
61
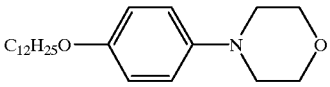
62
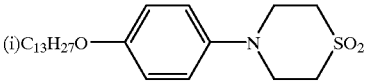
-continued
63
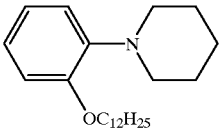
64
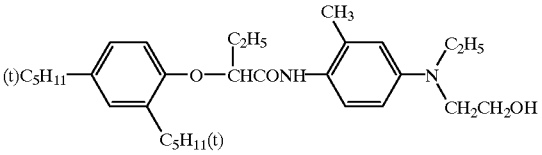
65
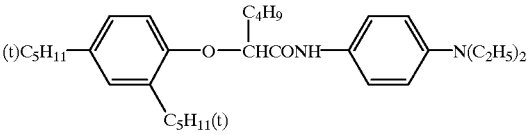
66
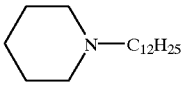
67
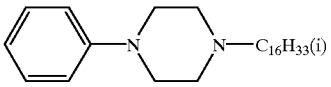
68
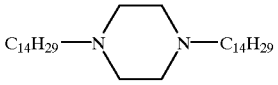
69
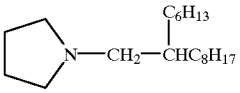
70
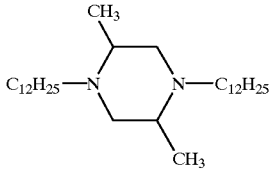
71
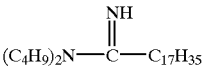
72
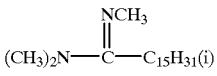
73
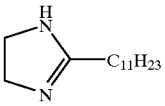
74
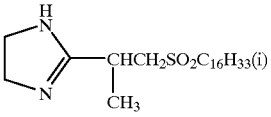

-continued
75
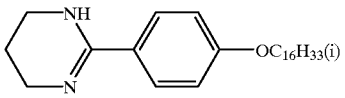
76
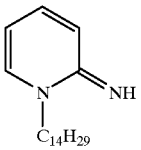
77
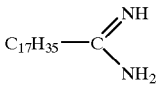
78
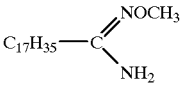
79
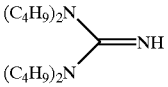
80
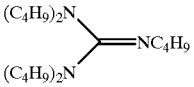
81
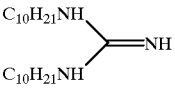
82
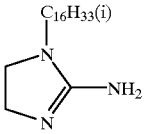
83
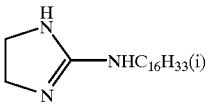
84
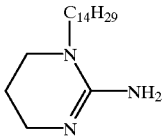
85
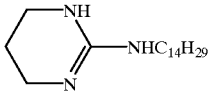
86
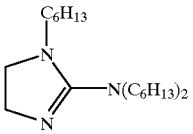
87
$(C_4H_9)_2NCH_2CH_2COOC_{14}H_{29}$
88
$(C_4H_9)_2NCH_2CH_2CONHC_{12}H_{25}$
-continued
89
$C_{10}H_{21}NHCH_2CH_2COOC_{14}H_{29}$
90
$H_2NCH_2CH_2SO_2C_{18}H_{37}$
91
$C_{12}H_{25}N(CH_2CH_2CN)_2$
92
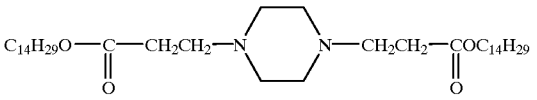
93
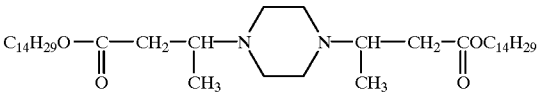
94
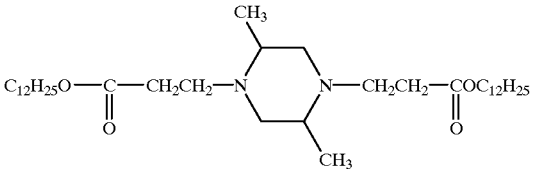
95
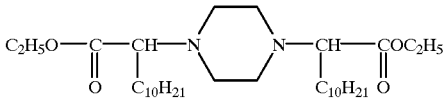
96
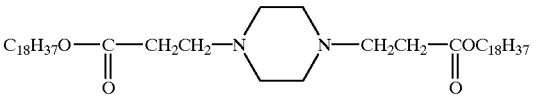
97
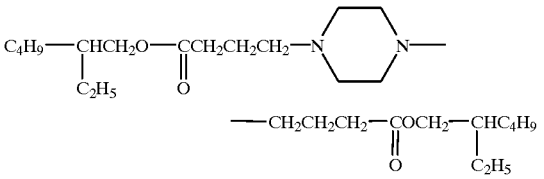
98
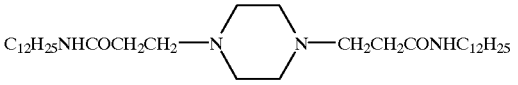
99
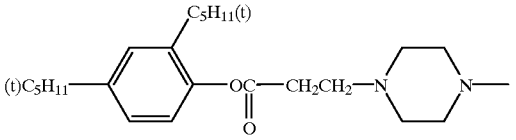
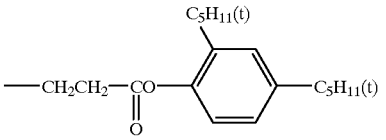
100
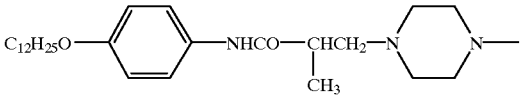

-continued
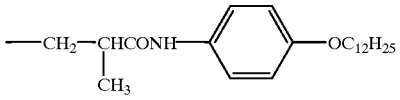
101
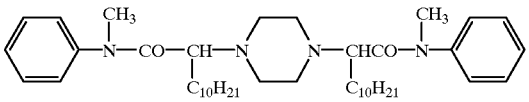
102
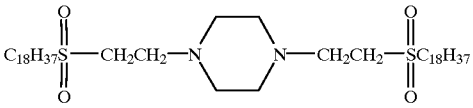
103
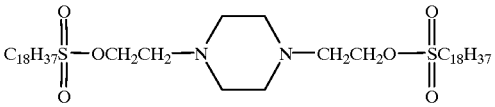
104
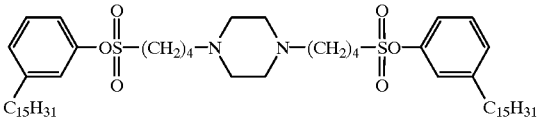
105
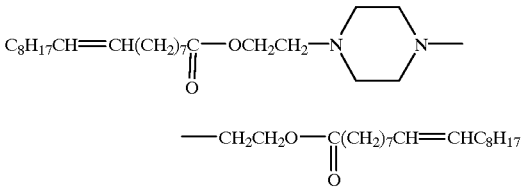
106
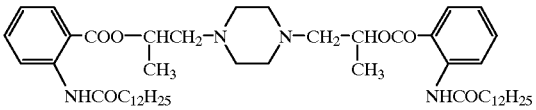
107
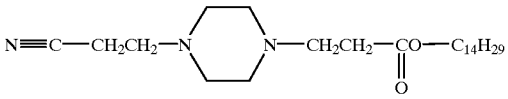
108
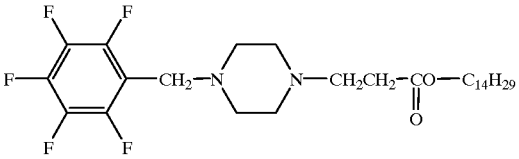
109
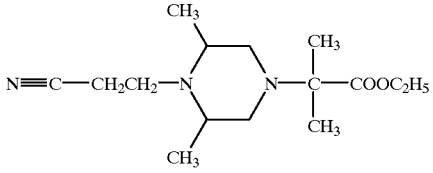
110
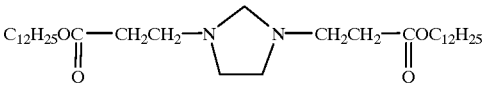
-continued
111
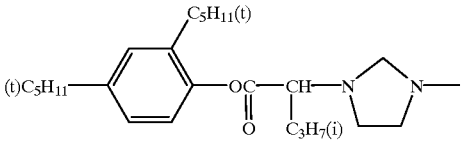
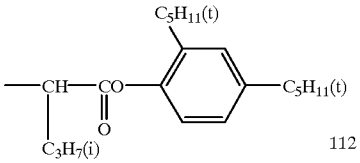
112
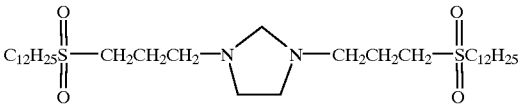
113
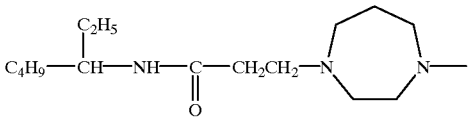
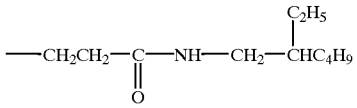
114
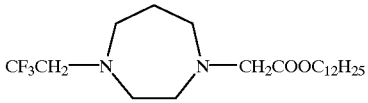
115
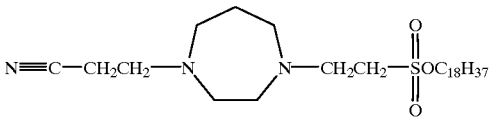
116
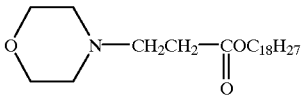
117
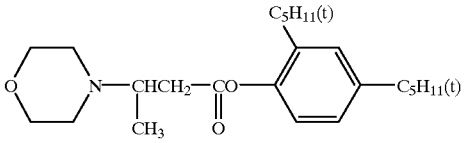
118
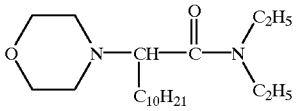
119
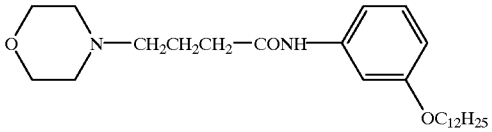

-continued
120
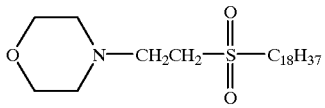
121
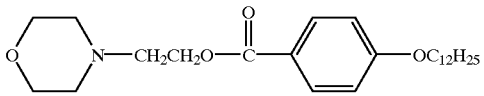
122
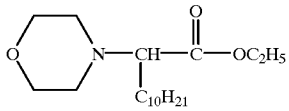
123
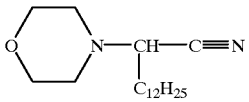
124
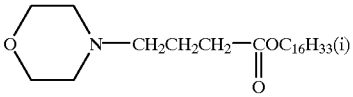
125
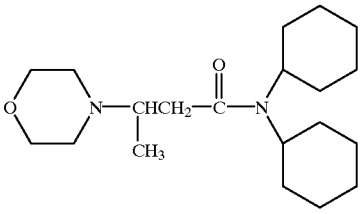
126
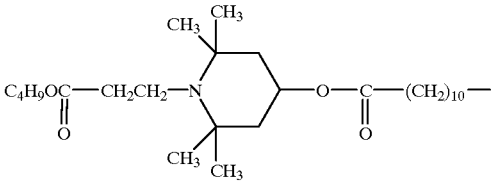
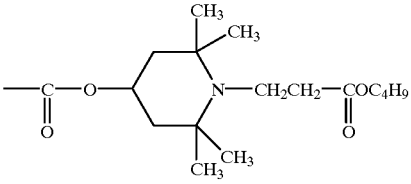
127
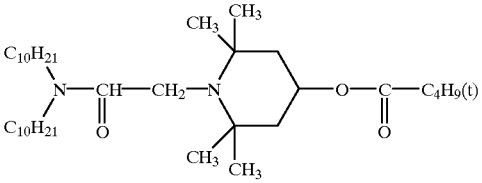
128
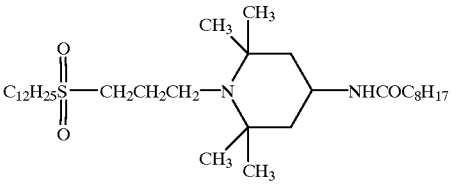
-continued
129
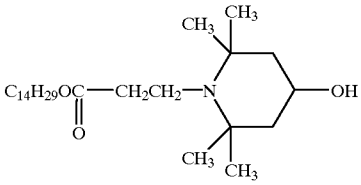
130
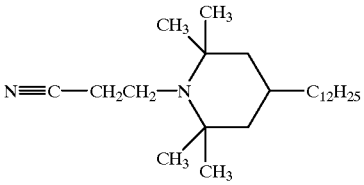
131
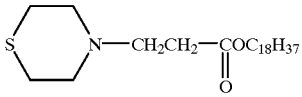
132
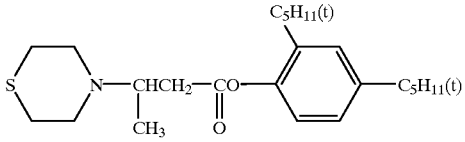
133
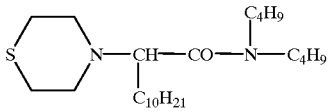
134
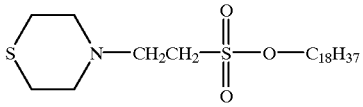
135
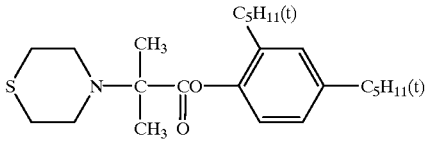
136
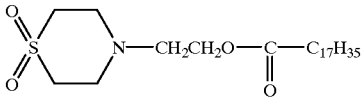
137
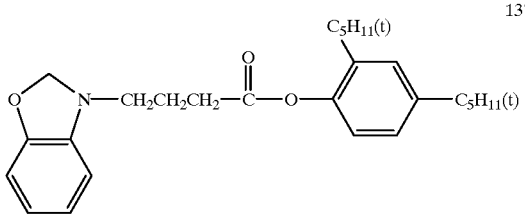
138
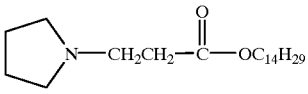

-continued

139

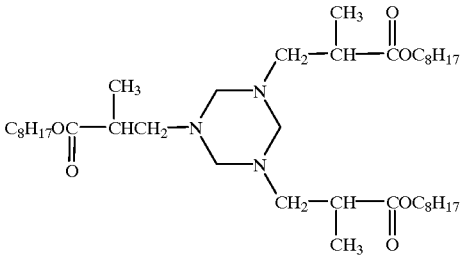

140

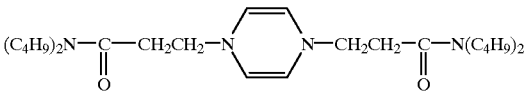

141

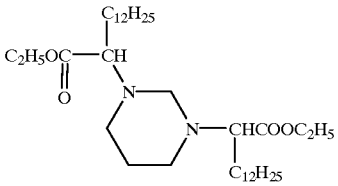

142

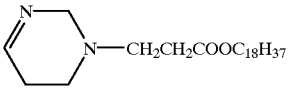

143

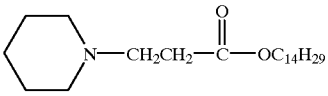

144

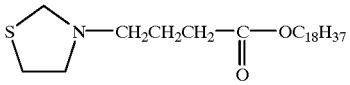

145

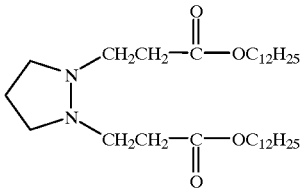

146

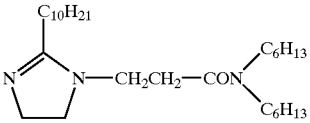

147

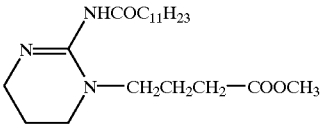

The amount used of the compound of the present invention may depends upon the kind of coupler used in combination. It is usually used in an amount of 0.1 to 30 mol % and preferably of 1–10 mol % of a coupler.

It is preferable that the compounds of the present invention is incorporated into a light sensitive emulsion layer containing a coupler or its adjoining layer. It is further preferable to add it to the red sensitive emulsion layer or a green sensitive emulsion layer.

Next, non-coloring and water-insoluble compounds will be explained.

In Formula (V), (Va) through (Vd), (Va-1), (Va-2), (Vd-1) and (Vd-2), examples of an electron attractive group of which Hammett's substituent constant σp value is 0.25 or more represented by X and X', are same electron attractive group cited as for the above-mentioned Formula (IV). Among these substituents, those substituted with an alkyl group or an aryl group (for example, an acetyl group, a benzoyl group, a methoxycarbonyl group and a phenoxycarbonyl group) may further be substituted with a substituent. For example, the following substituents are cited.

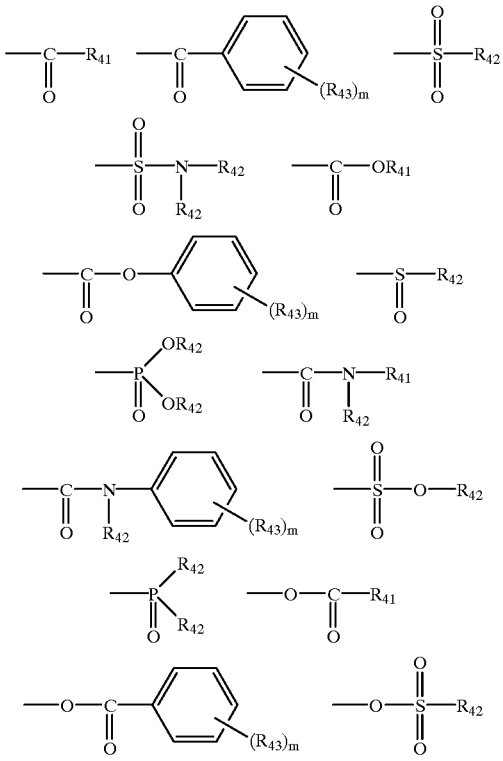

wherein $R_{41}$ represents a straight chained, branched or cyclic alkyl group; $R_{42}$ represents a hydrogen atom, an aryl group or $R_{41}$; m represents an integer of 0 to 5; $R_{43}$ represents a nitro group, a cyano group, an alkoxy group, an aryloxy group, an acyl group, an acyloxy group, an acylamino group, a sulfonamide group, a carbamoyl group, a sulfamoyl group, a sulfonyl group, a sulfinyl group, an alkoxycarbonyl group, an aryloxycarbonyl group, a sulfonyloxy group, a halogen atom, an aryl group, an alkylthio group, an arylthio group, an alkenyl group, a hydroxyl group or $R_{41}$; and the alkyl group represented by $R_{41}$ may be substituted by a substitute cited by $R_{43}$.

As an alkylene group represented by Y and Y' in which the carbon number in the main chain is 1 through 4, the following Formula can be represented.

Formula (Y)

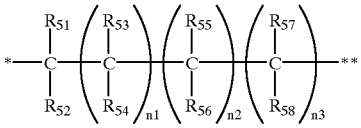

wherein $R_{51}$ through $R_{58}$ represents a hydrogen atom or a substituent cited in the above-mentioned $R_{43}$; $n_1$, $n_2$ and $n_3$ represents 0 or 1. In the formulas, * represents a side which substitutes with a nitrogen atom, and ** represents a side which substitutes with X or X'.

As an alkylene group in which the carbon number in the main chain represented by $Y_1$ is 1 through 3, the following Formula can be represented.

Formula ($Y_1$)

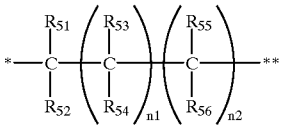

wherein $R_{51}$ through $R_{56}$ represents a hydrogen atom or a substituent citeded in the above-mentioned $R_{43}$; $n_1$ and $n_2$ represents 0 or 1. In the formulas, * represents a side which substitutes with a nitrogen atom, and ** represents a side which substitutes with X.

In Formula (Vd-2), as an alkylene group represented by $Y_2$ in which the carbon number in the main chain is 1 through 3, the following Formula ($Y_2$) can be represented in stead of those for $Y_1$.

Formula ($Y_2$)

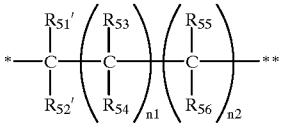

wherein $R_{51}'$ and $R_{52}'$ represent a hydrogen atom or a primary alkyl group; at least either of them represents a hydrogen atom; $R_{53}$ through $R_{56}$ represents a hydrogen atom or a substituent citeded in the above-mentioned $R_{43}$; $n_1$ and $n_2$ independently represent 0 or 1; and * represents a side which substitutes with a nitrogen atom, and ** represents a side which substitutes with X.

The maximum reason why a bonding group $Y_2$ which connects a nitrogen atom with X in a compound represented by Formula (Vd-2) is different from $Y_1$ is that both of the adjoining positions of the nitrogen atom in the compound represented by Formula (Id-2) are tertiary alkyl group (namely, $R_a'$, $R_b'$, $R_c'$ and $R_d'$ represent an alkyl group). Accordingly, the nitrogen atom is difficult to receive substituting reaction due to the steric hindrance by aforesaid tertiary alkyl group. Therefore, when the substituent of $R_{51}'$ and $R_{52}'$ in Formula ($Y_2$) is sterically massive, the reaction inherently does not advance, or synthesis yield is extremely low even if the reaction advances. As a result, it is inconvenient in terms of production cost as it is used as a photographic additive. Accordingly, $R_{51}'$ and $R_{52}'$ independently represent a hydrogen atom or a primary alkyl group. Concurrently with this, at least either of $R_{51}'$ and $R_{52}'$ represents a hydrogen atom.

Therefore, it is preferable that, the bonding group Y when $R_c$, $R_d$, $R_e$ and $R_f$ are concurrently an alkyl group among compounds represented by Formula (Vd), the bonding group $Y_1$ when four kinds of substituents, i.e., $R_a$, $R_b$, $R_h$ and $R_g$ or four kinds of substituents, i.e., $R_c$, $R_d$, $R_e$ and $R_f$ among compounds represented by Formula (Va-1) and the bonding group $Y_1$ when substituents $R_c$, $R_d$, $R_e$ and $R_f$ among compounds represented by Formula (Vd-1), substituents $R_{51}$, $R_{52}$ in Formulas (Y) and ($Y_1$) are the groups represented by $R_{51}'$ and $R_{52}'$.

In addition, among compounds represented by Formula (V), when both adjoining position of a nitrogen atom represented by

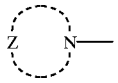

are tertiary carbons, and both adjoining position of a nitrogen atom inside a cycle in Formulas (Va), (Vb) and (Vc), the same matter can be referred.

In Formula (V), (Va) through (Vd), (Va-1), (Va-2), (Vd-1) and (Vd-2), a 5-member through 7-member nitrogen-containing heterocycle represented by

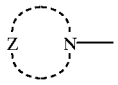

practically those having the following basic skeleton are cited. Such heterocycles may form a condensation ring, and may have a substituent explained in $R_{43}$.

5-member rings

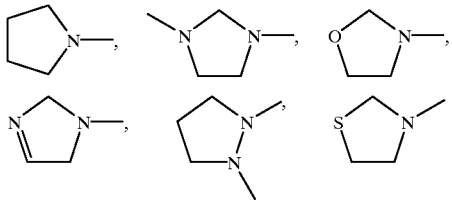

6-member rings

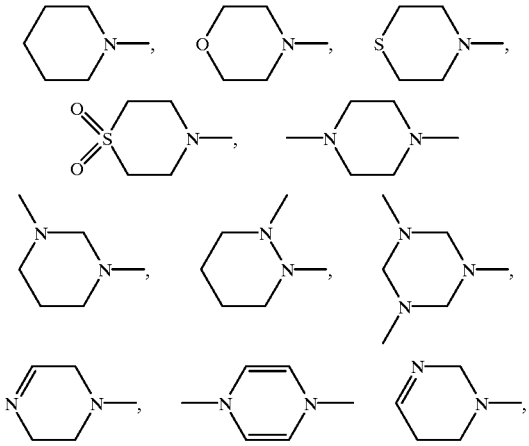

-continued

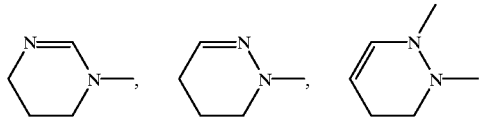

7-member ring

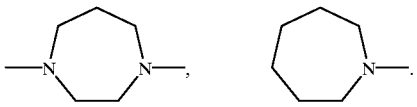

In Formulas (V), (Va) through (Vd), (Va-1), (Va-2), (Vd-1) and (Vd-2), alkyl groups represented by $R_{31}$, $R_{32}$, $R_{33}$, $R_a$–$R_j$, $R_a'$–$R_d'$ and $R_a''$–$R_d''$ may either be straight-chained, branched or cyclic. Further, they may have a substituent explained as for $R_{43}$.

An alkenyl group represented by $R_{32}$ may either be straight-chained, branched or cyclic. Further, it may have a substituent explained as for $R_{43}$.

Aryl groups represented by $R_{32}$ and $R_{33}$ basically represent a phenyl group, a 1-naphtyl group and a 2-naphtyl group. Further, they may have a substituent explained as for $R_{43}$.

Among electron attractive substituents represented by X, the preferable are as follows:

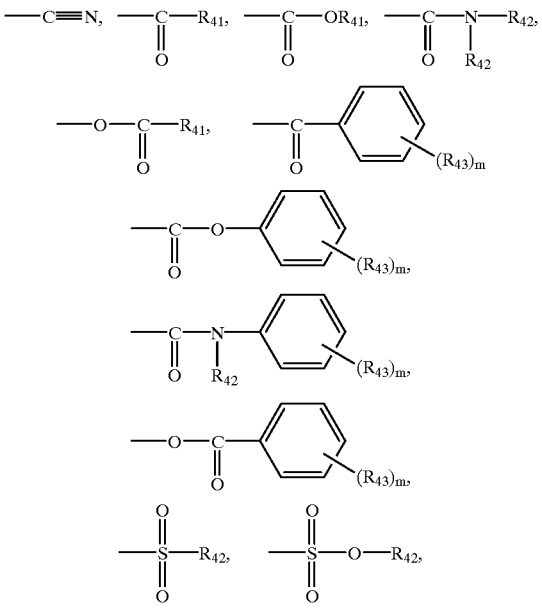

and

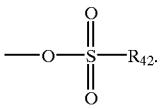

The most preferable examples are

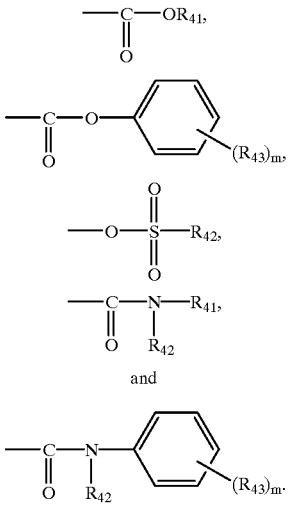

and

The most preferable is —$COOR_{41}$.

Among alkylene groups represented by Y, $Y_1$ and $Y_2$, the preferable are those in which $n_3$=0 and $n_2$ is 0 or 1 (namely, those represented by Formula ($Y_1$) The specifically more preferable are those in which, in Formula (Y), $n_2$=$n_3$=0 and, concurrently with this, $n_1$ is 0 or 1. The most preferable are those in which, in Formula (Y), $n_1$=1 and concurrently with this, $n_2$=$n_3$=0.

It is preferable that, among alkylene groups represented by Formulas (Y), ($Y_1$) and ($Y_2$), substituents represented by $R_{51}$ through $R_{58}$ are a hydrogen atom or an alkyl group. It is more preferable that all substituents are hydrogen atoms.

In Formula (V), among heterocycles represented by

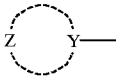

the preferable are those having the following basic skeletons:

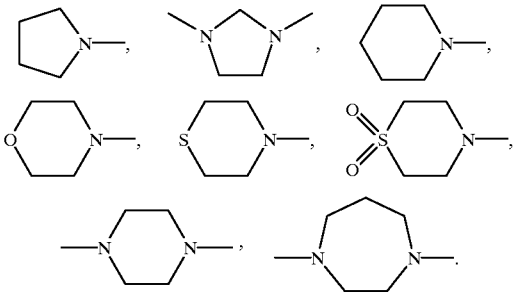

The more preferable are those having the following basic skeletons:

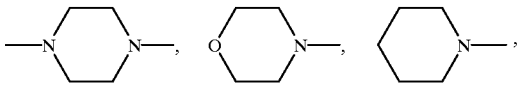

The most preferable are those having the following basic skeletons:

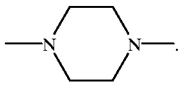

Basically, the compounds of the present invention are dispersed in a binder such as gelatin to be used, after dissolving in a high boiling organic solvent (HBS). Accordingly, it is preferable that the compounds of the present invention is water-insoluble and has high solubility in an organic solvent.

"Basic amino group" which was described in the explanation of Formula (V) as an excluded group is defined to be an amino group not having an electron attractive group such as a carbonyl group, a sulfonyl group, a sulfinyl group, a phosphonyl group and a cyano group adjacently. Practically, the basic amino group refers to as an alkyl group, an alkenyl group, an aryl group and an amino group substituted by a hydrogen atom. For example, substituents as follows:

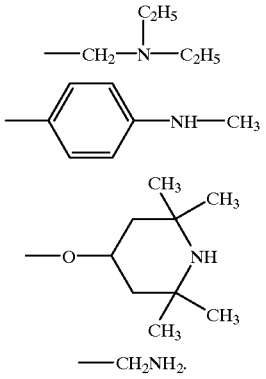

Exemplarily, the following compounds are excluded from the present invention.

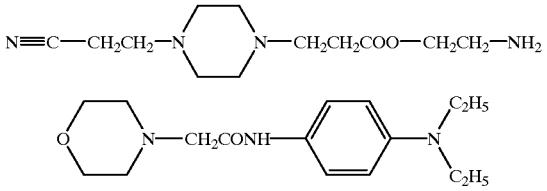

In the present invention, "water-insoluble compound" is a compound in which dissolved in 100 cc of pure water at 25° C. is in an amount of less than 0.1 g. Such compounds cannot be defined in terms of structure because the degree of dissolving in water varies depending upon skeleton or a substituent. As a target, it is preferable that the total carbon number of the molecule is 14 or more, and it is more preferable to be 16 or more.

As practical examples of compounds which are non-coloring and water-insoluble of the present invention, Nos. 92 through 147 (Chemical paragraphs 32 rough 42) in examples of compounds exhibited as the above-mentioned oil-soluble organic basic compounds.

Synthesis Example 1 (Synthesizing of illustrated compound 92)

In 20.0 g of myristyl acrylic acid, 3.2 g of pyperadine and 100 cc of ethanol were incorporated. The resulting mixture was heated and refluxed for 3 hours. The reacted solution was left cooling for one day. The deposited crystals were filtered. The resulting crystals were re-crystallized by means of ethanol so that 18.8 g of white crystal compound was obtained.

Structure of aforesaid compound was confirmed by means of $^1$HNMR, FD mass spectral and ID spectral.

Synthesis Example 2 (Synthesizing of illustrated compound 122)

In 30.7 g of α-ethyl bromolaurynic acid, 19.2 g of morphorine and 20 cc of methylacetoamide were added. The resulting mixture was heated and stirred at 100° C. for 5 hours. After cooling the resulting solution to room temperature, 100 cc of salt, 100 cc of ethylacetic acid and 10 cc of 1N hydrochloric acid were added and then separated. In addition, the resulting organic phase was cleaned twice with 100 cc of salt. Following this, the resulting substance was dried by means of magnesium sulfuric acid anhydrate. The solvent, i.e. ethyl acetic acid, was removed due to evacuation. Thus, an oily substance having faint yellowish color was obtained. Aforesaid substance was refined with a silica gel column chromatography. Thus, 213 g of compound 122 having faint yellowish color was obtained.

Structure of aforesaid compound was confirmed by means of $^1$HNMR, FD mass spectral and ID spectral.

The compounds of the present invention may be added to any layer in a light-sensitive material. However, it is preferable to add to a layer where a silver halide emulsion exists. Specifically, it is preferable that the compound of the present invention may be emulsified and dispersed together with a coupler and a high boiling organic solvent (HBS) in a silver halide emulsion layer. The compound is dissolved in the high boiling organic solvent (HBS) as well as coupler. The high boiling organic solvent (HBS) containing the compound of the invention and a coupler is dispersed in gelatin solution. The compound may be contained in an silver halide emulsion layer. The preferable example of the emulsion layer to contain the compound is green sensitive layer containing a magenta coupler. The preferable magenta coupler is a pyrazolone magenta coupler.

The amount of the compound varies depending upon an object be improved. It is preferable to be 0.1–300 mol % and more preferable to be 5–200 mol % against a coupler in a layer where the compound is added. If the compound is added to a non-sensitive layer, the added amount is preferably 0.05–100 mol %.

When the present invention is applied to a light-sensitive material for color print, the composition of the silver halide emulsion may be any ones which have arbitrary halogen composition such as silver chloride, silver bromide, silver bromochloride, silver bromoiodide, silver bromoiodochloride and silver iodochloride. However, silver bromochloride substantially not containing silver iodide in which silver chloride is contained by 95 mol % or more. From viewpoint of rapid processing property and processing stability, a silver halide emulsion having preferably 97 mol % or more and more preferably 98–99.9 mol % of silver chloride.

In order to obtain the silver halide emulsion of the present invention, a silver halide emulsion having a portion where containing silver bromide at high density. In this occasion, the portion where containing silver bromide at high density may have an epitaxy joint by silver halide emulsion grains or it may be a so-called core-shell emulsion. In addition, aforesaid portion does not form a complete layer where there are regions having different composition each other partially. In addition, the composition may be changed continuously or discontinuously. It is specifically preferable that the portion containing silver bromide at high density is the top of crystal grains on the surface of the silver halide grains.

In the silver halide emulsion of the present invention, heavy metal ion may be incorporated. As the heavy metal ion usable, metals of 8th to 10th group in th e periodic table such as iron, iridium, platinum, paradigm, nickel, rhodium, osmium, ruthenium and cobalt and transition metals in the 12th a group such as cadmium, zinc and mercury and lead, rhenium, molybdenum, tungsten and chrome. Of these, transitional metallic ions such as iron, iridium, platinum, ruthenium and osmium are preferable. The above-mentioned metallic ions can be added to the silver halide emulsion in a form of a salt and a complex salt.

In case that the above-mentioned heavy metal ion forms a complex, as its ligand or ion, cyanide ions, thiocyanate ions, cyanate ions, chloride ions, bromide ions, iodide ions, nitrate ions, carbonyl and ammonia are cited. Of these, cyanide ions, thiocyanate ions, isocyanate ions, chloride ions and bromide ions are preferable.

In order to incorporate the heavy metal ion in the silver halide emulsion, aforesaid heavy metal compound may be added at any place of each step, i.e., before forming silver halide grains, during forming the silver halide grains or during physical ripening after forming the silver halide grains. The heavy metal compound may be dissolved together with the halogenide salt and be added at all through the grain forming step continuously or at a part of aforesaid step.

The added amount of the heavy metal ion into the silver halide emulsion, $1\times10^{-9}$ to $1\times10^{-2}$ mol is preferable and $1\times10^{-3}$ to $1\times10^{-5}$ mol per mol of silver halide is specifically preferable.

With regard to the form of the silver halide grains, arbitrary ones may be used. One of preferable examples is cubic having (100) plane as a crystal surface. In addition, by methods described in U.S. Pat. Nos. 4,183,756 and 4,225,666, Japanese Patent O.P.I. Publication No. 55-26589, Japanese Patent Publication No. 55-42737 and The Journal of Photographic Science (J. Photogr. Sci.) 21, 39 (1973), grains having octagonal, tetradecahedral and dodecahedral crystal are formed to be used. In addition, grains having twinned surface may be used. With regard to the silver halide grain, grains composed of a single form may be used. In addition, grains in which various forms are mixed may be used.

There is no limit to the grain size of the silver halide grain. Considering other photographic performances such as rapid processing property and sensitivity, the range of 0.1–1.2 $\mu$m is preferable and 0.2–1.0 $\mu$m is more preferable. The above-mentioned grain size can be measured by means of each method commonly employed in the relevant technical field. Typically, methods described in "Grain Size Analysis Method" by Loveland (A.S.T.M. Symposium on Light Microscopy, pp. 94–122 (1955) or "Theory of Photographic Process Third Edition" (written by Meeth and James, 2nd chapter, published by MacMillan Inc., 1966).

Aforesaid grain size can be measured by the use of a projected area of the grain or a diameter approximate value. If the grain is substantially uniform, the grain size distribution can considerably be represented in terms of a diameter or a projected area.

The distribution of the grain size of the silver halide grain used for the present invention may be polydispersed. However, preferably a mono-disperse silver halide grain whose variation coefficient was preferably 0.22 or less and more preferably a mono-dispersed silver halide grains whose variation coefficient was 0.15 or less. It is specifically preferable to add two or more kinds of mono-dispersed emulsions whose variation coefficient is respectively 0.15 or less. Here, the variation coefficient is a coefficient representing the width of grain size distribution, and is defined by the following equation:

variation coefficient=S/R (S: the standard variation of the grain size distribution, R: average grain size)

wherein, the grain size is defined to be a diameter in the case of a spherical silver halide grains. In addition, the form of the grain is other than cubic or spherical, it is defined to represent a diameter when its projected image is converted to a cycle image having the same area.

As a preparation apparatus and the method of the silver halide emulsion, various conventional methods in the relevant field can be used.

The silver halide emulsion of the present invention may be produced by means of any of an acidity method, a neutral method and an ammonia method. Aforesaid grain may be grown linearly. In addition, aforesaid grain may be grown after seed grains were prepared. A method to prepare a seed grain and a method to grow may be the same or different.

In addition, with regard to a style to react a soluble silver salt and a soluble halide product, any methods including an ordinary mixing method, a reverse mixing method 63 and their mixture may be adopted. Among these, a double jet method is preferable. As one style of the double jet method, a pAg controlled double jet method described in Japanese Patent O.P.I. Publication No. 54-48521 can be used.

Further, if necessary, silver halide solvent such as thioether may be used. In addition, compounds having a mercapto group, a nitrogen-containing heterocyclic compound or a sensitizing dye may be added during forming the silver halide grains or after the finish of the formation of the grains.

From viewpoint of suitability to rapid processing, the coated silver amount of the color light-sensitive material of the present invention is preferably 0.9 g/m$^2$ or less, more preferably 0.7 g/m$^2$ or less and most preferably 0.6 g/m$^2$ or less.

With regard to the sensitizing method of the silver halide emulsion, a sensitizing method using a sulfur compound, a sensitizing method using a gold compound and a sensitizing method employing sulfur and gold compound in combination. As a sulfur sensitizer preferably used, thiocyanate, alylthiocarbamide urea, alylisothiacyanate, cystine, p-toluenethiosulfonate, rhodanine and inorganic sulfur are cited.

As a preferable gold sensitizer, in addition to chloro auric acid and gold sulfide, each gold complex and the above-mentioned gold compound may preferably be used.

In the silver halide emulsion, conventional anti-foggants and stabilizers may be incorporated, in order to prevent fogging which occurs during manufacturing step in the light-sensitive material, to reduce performance variation during storage and to prevent fogging which occurs in developing. As examples of compounds usable for aforesaid object, compounds represented by Formula II described Japanese Patent O.P.I. Publication No. 2-146036, page 7, on the lower column. As the practical compound. As the practical compounds, compounds (IIa-1) through (IIa-8), (IIb-1), through (IIb-7) described on page 8, compounds (IIb-1) through (IIb-7), compounds such a 1-(3-methoxyphenyl)-5-mercaptotetrazole and 1-(4-ethoxyphenyl)-5-mercaptotetrazole are cited. These compounds may be added during the preparation step of the silver halide grains, during the chemical sensitizing step or at the end of the chemical sensitizing step and a coating composition preparation step.

To the light-sensitive material of the present invention, for the purpose of anti-irradiation and anti-halation, dye which have absorption various wavelength region. For this purposes, any of conventional compounds can be used.

Specifically, as a dye having absorption in a visible region, AI-1 to II described in Japanese Patent O.P.I. Publication No. 3-251840, page 308 and dyes described in Japanese Patent O.P.I. Publication No. 6-3770 are preferably used. As a infrared absorption dye, compounds represented by Formula (I), (II) and (III)described in Japanese Patent O.P.I. Publication No. 1-280750 has a preferable spectral property. It has no adverse influence on the photographic property of the silver halide emulsion. In addition, there is no contamination due to color residue. As practical examples of preferable compounds, illustrated compounds (1) through (45) cited in the above-mentioned Japanese Patent O.P.I. Publication, lower left column on page 3 to lower left column on page 5 are cited.

With regard to the added amount of the above-mentioned dyes, for the purpose of improving sharpness, one in which the spectral reflective density at 680 nm of an un-processed sample of the light-sensitive material is 0.7 or more. More preferably, 0.8 or more.

The color light-sensitive material of the present invention has a layer containing a silver halide emulsion which has been subjected to spectral sensitizing to a specific region of 400–900 nm, by combining with a yellow coupler, a magenta coupler and a cyan coupler. In aforesaid silver halide emulsion, one or two or more kinds of sensitizing dye may be combined to be incorporated.

As a useful sensitizing dye, a cyanine dye, a merocyanine dye and a complex merocyanine dye are cited.

As a coupler used for the color light-sensitive material of the present invention, any compounds which can form a coupling generated product having a spectral absorption maximum at a wavelength region longer than 340 nm due to coupling reaction with an oxidized product of a color developing agent. Typically, a yellow coupler having the spectral absorption maximum at 350–500 nm, a magenta coupler having the spectral absorption maximum at 500–600 nm and a cyan coupler having the spectral absorption maximum at 600–750 nm are well known.

As a yellow dye forming coupler, an acylacetoanilido type coupler is used. Of these, a benzoyl acetoanilido based and a pivaloyl acetoanilido based compounds are useful.

As a yellow coupler preferable usable in the present invention, couplers represented by formula (Y-1) described in Japanese Patent O.P.I. Publication No. 4-114154, page 11 are cited. As a practical compounds, those described in YC-1–9 in aforesaid specification may be cited.

As a magenta dye forming coupler, a 5-pyrazolone based coupler, a pyrazolone benzimidazole based coupler. a pyrazoloazole based coupler and an open-chained acylacetonitrile based coupler are cited.

As a magenta coupler preferably usable for the present invention, couplers represented by (M-I) and (M-II) described in Japanese Patent O.P.I. Publication No. 114154/1992, page 12. Practically, those described as MC-1 through 11 in aforesaid specification, pp.13–16 are cited.

As a cyan dye forming coupler, a naphthol based couple, a phenol based coupler and an imidazole based coupler can be used.

As a cyan coupler preferably usable in the present invention, couplers represented by Formulas (C-1) and (C-II) described in Japanese Patent O.P.I. Publication No. 4-114154, page 17 are cited. Practically, those described as CC-1 through 14 in aforesaid specification, pp. 18–21 are cited.

In order to add a coupler to a color light-sensitive material, if an oil-in-water drop type emulsifying and dispersion method is used, in a water-insoluble high boiling organic solvent whose boiling point was 150° C. or more, a low boiling and/or water-soluble organic solvent were dissolved in combination. In a hydrophilic binder such as gelatin, a surfactant was added to the above-mentioned solvent to be emulsified and dispersed. As a dispersing means, a stirrer, a homogenizer, a colloidal mill, a flow jet mixer and a ultrasonic dispersing machine may be used. After dispersion, or concurrently with dispersion, a step to remove a low-boiling organic solvent may be added. As a high boiling organic solvent for dissolving a coupler and to disperse, ester phthalic acid such as dioctylphthalate and an ester phosphate such as a ester triicresyl photphate are preferably used.

In place of a method to employ a high boiling organic solvent, a method to dissolve a coupler and a polymer compound which is water-insoluble and organic solvent soluble is dissolved in a low boiling and/or water-soluble organic solvent as necessary, and the resulting mixture is emulsified and dispersed using a surfactant in a hydrophilic binder such as an aqueous gelatin solution by means of various dispersion means. In this occasion, as a water-insoluble organic solvent solubable polymer, poly(N-t-butylacrylic amide) are cited.

To the above-mentioned coupler, in order to minimize color fading due to light, heat and humidity of a dye image formed, it is preferable to an anti-color fading agent. The specifically preferable compounds are phenylether compounds represented by Formulas I and II described in Japanese Patent O.P.I. Publication No. 2-66541, phenol compound represented by Formula B described in Japanese Patent O.P.I. Publication No. 3-174150, amino type compounds represented by Formula B in Japanese Patent O.P.I. Publication No. 64-90445 and metal complexes represented by Formula XII, XIII, XIV and XV described in Japanese Patent O.P.I. Publication No. 62-182741, specifically as a magenta dye use. In addition, compounds represented by Formula I' described in Japanese Patent O.P.I. Publication No. 1-196049 and compounds represented by Formula II described in Japanese Patent O.P.I. Publication No. 5-11417 are preferable as yellow and cyan dye use.

In order to shift the absorption wavelength of the coloring dye, compound (d-11) described in Japanese Patent O.P.I. Publication No. 4-114154, page 33 and compound (A'-1) described in aforesaid specification, page 35 can be used. In addition, other than these, a fluorescent dye releasing compound described in U.S. Pat. No. 4,774,187 can be used.

In the present invention, gelatin is used as a binder. As necessary, gelatin derivatives, graft polymer between gelatin and other polymer, proteins other than gelatin, sugar derivatives, cellulose derivatives and a hydrophilic colloid such as a mono- or copolymer synthetic hydrophilic polymer substance can be used in combination with gelatin.

Gelatin used here may be lime-processed gelatin or acid-processed gelatin. In addition, gelatin whose raw materials are cow bone, cow skin and pig skin. The preferable is a lime-processed gelatin in which the raw material is a cow bone and a pig bone.

In the present invention, the total amount of contained in a light-sensitive silver halide emulsion layer and a non-sensitive hydrophilic colloidal layer containing in the silver halide emulsion layer which is the closest to the support through the hydrophilic colloidal layer which is farest from the support on a side where the silver halide emulsion layer was coated is preferably 7.5 g or less and more preferably 4 g or more and less than 7 g from viewpoint of the suitability to rapid processing and sensitivity.

In a photographic emulsion layer and other hydrophilic colloidal layer in the light-sensitive material, for the purpose of preventing corrosion of a hydrophilic colloid such as gelatin, anti-mildew agents such as an N-nitroethylmorphorine compound, an isothiazolone compound, a phenol compound and a phenoxyethanol compound can be employed.

The photographic emulsion layer and other hydrophilic colloidal layer of the light-sensitive material are hardened by bridging a binder molecule (or a protective colloid) and by employing a hardener which enhances the strength of the layer singly or in combination.

To the light-sensitive material, other than the above-mentioned compounds, various photographic additive may be added. For example, UV absorbers (for example, benzophenone based compounds and benzotriazole based compound), development accelerators (for example, 1-aryl-3-pyrazolidone based compound), water-soluble anti-irradiation dyes (for example, an azo based compound, a styryl based compound and oxynol based compound), layer physical property improver (liquid paraphine and plyalkylene glycol), anti-stain agent (anti-diffusion hydroquinone based compounds), color image stabilizers (for example, hydroquinone derivatives, gallic acid derivatives), water-soluble or oil-soluble fluorescent brightening agents and groundness regulators are cited. In addition, as necessary, competitive coupler, fogging agents, development inhibitor releasing type couplers (so-called DIR coupler) and development inhibitor releasing compounds may be added.

As a support used for the color light-sensitive material of the present invention, any materials can be used. For example, paper laminated with polyethylene and polyethylene terephthalate, paper support composed of natural pulp and synthetic pulp, vinyl chloride sheet, polypropylene which may contain a white pigment, polyethylene terephthalate support and baryta paper can be used. Of these, a support having a moisture resistance resin covering layer on the both surface of the raw paper is preferable. As a moisture resistance resin, polyethylene, polyethylene terepgthalate or their copolymers are preferable.

As a white pigment used for the support, inorganic and/or organic white pigments can be used. Preferably, inorganic white pigment is preferable. For example, sulfate of alkaline earth metal such as barium sulfate, carbonate of an alkaline earth metal such as calcium carbonate, fine silicas such as fine silicate and synthetic silicate, calcium silicate, alumina, almina hydrate, titanium oxide, zinc oxide, talc and cray are cited. The preferable white pigment is barium sulfate and titanium oxide.

The added amount of white pigment contained in the moisture resistance resin layer on the surface of the support, 13 wt % or more is preferable and 15 wt % or more is more preferable from viewpoint of improving sharpness.

In the case of a transparent support, in order to prevent light piping phenomenon (fringe fogging) which occurs when light incidences to the transparent support on which photographic emulsion layers are coated from the edge, it is preferable to incorporate a dye in a support. There is no limit to a dye which is arranged for such purposes. From viewpoint of producing a film, a dye excellent in heat resistance is preferable. For example, an anthraquinone based dyes are cited. In addition, as a color tone of the transparent support, gray dye as shown in an ordinary light-sensitive material is preferable. One kind or two kinds of dyes may be mixed. As the above-mentioned dye, SUMIPLAST produced by Sumitomo Chemical, Diaresin produced by Mitsubishi Kasei and MACROLEX produced by Bayer can be used singly or admixture can be used in combination.

When a silver halide emulsion layer and a hydrophilic colloidal layer are coated on a support used in the present invention, a viscosity increasing agent may be used for improving coating property. As a coating method, an extrusion coating method and a curtain coating methods in which two or more layers can be coated concurrently.

In order to form a photographic image using a color light-sensitive material of the present invention, an image to be recorded on a negative film may be optically image-sensed onto the light-sensitive material to be printed. In addition, an image is temporarily converted to digital information. Following this, aforesaid image is image-sensed on a CRT (Cathode Ray Tube), and aforesaid image is image-sensed on a light-sensitive material to be printed. Further, based on digital information, an image may be printed by changing the intensity of laser beam and scanning.

The color light-sensitive material of the present invention may form an image by applying a conventional color developing processing.

As an aromatic primary amine based developing agent used in the present invention, conventional compounds may be used. Typical examples thereof will be exhibited as follows:

CD-1: N,N-diethyl-p-phenylenediamine
CD-2: 2-amino-5-diethylaminotoluene
CD-3: 2-amino-5-(N-ethyl-N-laurylamino)toluene
CD-4: 4-amino-3-methyl-N-ethyl-N-(β-buthoxyethyl) aniline
CD-5: 2-methyl-4-(N-ethyl-N-β-hydroxyethyl) aminoaniline
CD-6: 4-amino-3-methyl-N-ethyl-N-(β-(methanesulfoneamide) ethyl)aniline
CD-7: 2-β-methanesulfonamideethyl-4-diethylaminoaniline
CD-8: N,N-dimethyl-p-phenylenediamine
CD-9: 4-amino-3-methyl-N-ethyl-N-methoxyethylaniline
CD-10: 4-amino3-methyl-N-ethyl-N-(β-ethoxyethyl)aniline
CD-11: 4-amino-3-methyl-N-ethyl-N-(γ-hydroxyproyl) aniline A color developing agent may used in a range of $1\times10^{-2}$ to $2\times10^{-1}$ mol per liter of developing solution. From viewpoint of rapid processing, it is preferable that the color developing solution is used in a range of $1.5\times10^{-2}$ to $2\times10^{-1}$ mol. The color developing solution may be used singly, or it may be used in combination with other conventional p-phenylenediamine derivative.

In the color developing solution, other than the above-mentioned components, the following developing solution components may be incoporated. For example, as an alkaline agent, sodium hydroxide, potassium hydroxide, sodium methaborate, potassium methaborate, trisodium phosphoric acid, tripotassium phosphoric acid, borax and silicate salt may be used independently or admixture thereof may be used, provided that there is no occurrence of precipitation and pH stabilizing effects may be maintained. In addition, due to necessity of preparation of the agent, or in order to enhance ion intensity, various salts such as disodium hydrophosphate, dipotassium hydrophosphate, sodium bicarbonate, potassium bicarbonate and borate may be used.

In addition, as necessary, inorganic and organic anti-fogging agents may be added. For the purpose of development inhibiting, halide ions are mainly used. In order to finish development in a short time, mainly chloride ions such as potassium chloride and sodium chloride are used. The amount of the chloride ion is $3.0\times10^{-2}$ mol or more and preferably $4.0\times10^{-2}$ to $5.0\times10^{-1}$ mol per liter of a color developing solution. Bromide ions may be used as long as not hindering the effects of the present invention. It has noticeable effects to inhibit development. Therefore, $1.0\times10^{-3}$ mol or less and preferably $5.0\times10^{-4}$ or less are preferable.

Further, as necessary, a development accelerator may be used. As the development accelerator, each pyridium compounds typically disclosed in U.S. Pat. Nos. 2,648,604, 3,671,247 and Japanese Patent Publication No. 44-9503, other cationic compounds, cationic dye such as phenosafranine, neutral salts such as thallium nitrate, polyethylene glycol and it derivatives as disclosed in U.S. Pat. Nos. 2,533,990, 2,531,832, 2,950,970 and 2,577,127 and Japanese Patent Publication No. 44-9504, nonionic compounds such as polythioethers, organic solvents described in Japanese Patent Publication No. 44-9509, ethanolamine, ethylenediamine, diethanolamine and triethanol amine are included. In addition, phenetyl alcohol described in U.S. Pat. No. 2,304,925. In addition, acetylene glycol, methylethylketone, cyclohexanone, pyridine, ammonia, hydradine, thioethers and amines are cited.

Further, in the color developing solution, as necessary, ethylene glycol, methylcellusolve, methanol, acetone, dimethylformamide, β-cyclodextrine and compounds described in Japanese Patent Publication Nos. 47-33378 and 44-9509 can be used as organic solvents for enhancing the degree of dissolvability of the developing agent.

Together with a developing agent, an auxiliary developing agent may be used. As the auxiliary developing agent, for example, N-methyl-p-aminophenol sulfate, phenydone, N,N-diethyl-p-aminophenol hydrochloric acid and N, N, N'-tetramethyl-p-phenylenediamine hydrochloric acid are known. As the amount thereof, ordinarily, 0.01–1.0 g per liter of developing solution is used.

Each component of the above-mentioned color developing solution may be prepared by adding and stirring successively to a stipulated amount of water. In this occasion, components having low solbility in water may be added after mixing with the above-mentioned organic solvent. In addition, usually, plural components which can stably co-exist each other is preliminary prepared in a small contained in a condensed aqueous solution state or a solid state, and then, the mixture was added to water and stirred for the preparation.

When processing a color light-sensitive material of the present invention, the color developing solution can be used at an arbitrary pH region. From viewpoint of rapid processing, pH of 9.5–13.0 is preferable. The more preferable is pH at 9.8–12.0. The processing temperature of color developing is preferably 15–45° C., and more preferably 20–45° C.

Time for color developing is ordinarily about 3 min. and 30 sec. In the present invention, it is reduced to 1 minute, and it is preferable to be reduced to 50 seconds or less.

In the present invention, when running processing is conducted in which a color light-sensitive material is processed while the color developing solution is continuously replenished, in order to reduce the overflow solution of the color developing solution and in order to minimize environmental damage due to effluent, it is preferable that the amount of the replenishing solution is 20–150 cc per $m^2$ of light-sensitive material. Further, the replenishment amount is reduce in such a manner that effluent due to overflow never occur. Practically, 20–60 cc per $m^2$ is specifically preferable. Under the above-mentioned condition, performance of the light-sensitive material is easy to be changed. However, the color light-sensitive material of the present invention can specifically be used advantageously.

The color light-sensitive material may be subjected to bleaching processing and fixing processing after color developing step. The bleaching processing may be conducted simultaneously with the fixing processing. After fixing processing, ordinarily, washing processing is applied. In addition, in place of washing processing, stabilizing processing may be provided. As a developing apparatus used for developing of the light-sensitive material of the present invention, a roller transport type in which the light-sensitive material is sandwiched by rollers located in the processing tank for conveyance or an endless belt type in which the light-sensitive material is fixed on the belt for conveying. In addition, a method in which processing tanks are formed in a slit shaped and the light-sensitive material is conveyed together with feeding the processing solution to aforesaid processing tank, a spray type in which the processing solution is sprayed, a web type in which the light-sensitive material contacts a carrier in which the processing solution is immersed and a type employing a viscosity processing solution may be used.

When a light-sensitive material for color negative film or a color reversal film are prepared employing the compounds of the present invention, there is no limit to the order of layer lamination of each light-sensitive layer of aforesaid light-sensitive material. Depending upon the purpose, various layer lamination order can be considered. For example, from the support side, a red sensitive layer, a green sensitive layer and a blue sensitive layer can be laminated in this order. On the contrary, from the support side, a blue sensitive layer, a green sensitive layer and a red sensitive layer can be laminated in this order.

In addition, between two light-sensitive layer having the same sensitivity each other, a light-sensitive layer having different sensitivity may be sandwiched. In addition, in order to improve color reproducibility, in addition to the red sensitive layer, the green sensitive layer and the blue sensitive layer, 4th or more light-sensitive layers may be provided. With regard to a layer structure in which 4th or more light-sensitive layer are provided, see Japanese Patent O.P.I. Publication Nos. 61-34541, 61-201245, 61-198236 and 62-160448.

In such occasion, the 4th or more light-sensitive layer may be located at any layer lamination position. In addition, the 4th or more light-sensitive layer may be composed singly or by plural layers. In addition, between each light-sensitive layer and the uppermost layer and the lower most layer, each non-light-sensitive layer may be provided In the above-mentioned non-sensitive layer, couplers and DIR compounds may be incorporated. In addition, conventional anti-color stain agents may be incorporated. Further, filter layers and intermediate layers described in RD308119, page 1002, VII-K may be provided.

Hereinafter, the present invention will be explained referring to Examples.

EXAMPLE 1

On the both surface of paper pulp whose weight was 180 $g/m^2$, a high density polyethylene was laminated for forming a paper support. On a side on which emulsion layers were.coated, polyethylene containing 15 wt % of an anatase titanium oxide in a dispersion state was laminated for preparing a reflective support.

On aforesaid reflective support, each layer having the following compostion was coated to form light-sensitive material sample 101 was prepared. The coating compostion was prepared as followed.

Coating Composition for the First Layer

To 23.4 g of yellow coupler (Y-1), 3.34 g of dye image stabilizer (ST-1), 3.34 g of ST-2, 3,34 g of ST-5, 0.33 g of anti-stain,agent (HQ-1), 5.0 g of compound A and 5.0 g of high boiling organic solvent (DBP), 60 cc of ethyl acetic acid was added for solving. Aforesaid solution was emulsified and dispersed in 220 cc of an aqueous 10% gelatin solution containing 7 cc of 20% surfactant (SU-1) using a supersonic homogenizer for preparing a yellow coupler dispersing solution. This dispersing solution was mixed with a blue sensitive silver halide emulsion prepared under the following conditions for preparing a coating composition for the first layer.

Coating compositions for the second layer through the seventh layer were prepared as shown in Tables 1 and 2.

In addition, as hardeners, H-1 and H-2 were added. As a coating aid, surfactants SU-2 and SU-3 were added to regulate surface tension. In addition, F-1 was added to each layer in such a manner that the total amount was 0.04 g/m$^2$.

TABLE 1

| Layer | Constitution | Amount (g/m$^2$) |
|---|---|---|
| 7th layer (Protective layer) | Gelatin | 1.00 |
| | DIDP | 0.005 |
| | Silicone dioxide | 0.003 |
| 6th layer (UV absorber) | Gelatin | 0.40 |
| | AI-2 | 0.01 |
| | UV absorber (UV-1) | 0.12 |
| | UV absorber (UV-2) | 0.04 |
| | UV absorber (UV-3) | 0.16 |
| | Anti-stain agent (HQ-5) | 0.04 |
| | PVP | 0.03 |
| 5th layer Red sensitive layer) | Gelatin | 1.30 |
| | Red sensitive silver bromochloride emulsion (Em-R) | 0.21 |
| | Cyan coupler (C-1) | 0.25 |
| | Cyan coupler (C-2) | 0.08 |
| | Dye image stabilizer (ST-1) | 0.10 |
| | Anti-stain agent (HQ-1) | 0.004 |
| | DOP | 0.34 |
| 4th layer (UV absorber) | Gelatin | 0.94 |
| | UV absorber (UV-1) | 0.28 |
| | UV absorber (UV-2) | 0.09 |
| | UV absorber (UV-3) | 0.38 |
| | AI-2 | 0.02 |
| | Anti-stain agent (HQ-5) | 0.10 |

TABLE 2

| Layer | Constitution | Amount (g/m$^2$) |
|---|---|---|
| 3rd layer (Green sensitive layer) | Gelatin | 1.30 |
| | AL-1 | 0.01 |
| | Green sensitive silver bromochloride emulsion (Em-G) | 0.14 |
| | Magenta coupler (M-1) | 0.20 |
| | Dye image stabilizer (ST-3) | 0.20 |
| | Dye image stabilizer (ST-4) | 0.17 |
| | DISP | 0.13 |
| | DBP | 0.13 |
| 2nd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.06 |
| | Fluorescent brightening agent (W-1) | 0.10 |
| 1st layer (Blue sensitive layer) | Gelatin | 1.20 |
| | Blue sensitive silver bromochloride emulsion (Em-B) | 0.26 |
| | Yellow coupler (Y-1) | 0.70 |
| | Dye stabilizer (ST-1) | 0.10 |
| | Dye stabilizer (ST-2) | 0.10 |
| | Anti-stain agent (HQ-1) | 0.01 |
| | Dye stabilizer (ST-5) | 0.10 |
| | Compound A | 0.15 |
| | DBP | 0.15 |
| Support | Polyethylene-laminated paper (Fine amount of colorant is contained) | |

Added amount of silver halide emulsion was denoted in terms of silver.

SU-1: Sodium tri-i-propylnaphthalene sulfonic acid

SU-2: Sodium salt of sulfosuccinic acid di(2-ethylhexyl)

SU-3: Sodium salt of sulfosuccinic acid di (2,2,3,3,4,4,5,5-octafluoropentyl

DBP: Dibutylphthalate

DNP: Dinonylphthalate

DOP: Dioctylphthalate

DIDP: Di-i-decylphthalate

PVP: Polyvinyl pyrrolidone

H-1: Tetrakis(vinylsulfonylmethyl)methane

H-2: Sodium 2,4-dichloro-6-hydroxy-s-triazine

Compound A: p-t-octylphenol

HQ-1: 2,5-di-t-octyl hydroquinone

HQ-2: 2,5-di-sec-dodecyl hydroquinone

HQ-3: 2,5-di-sec-tetradecyl hydroquinone

HQ-4: 2-sec-dodecyl-5-sec-tetradecyl hydroquinone

HQ-5: 2,5-di(1,1-dimethyl-4-hexyloxycarbonyl)butyl hydroquinone

Y-1
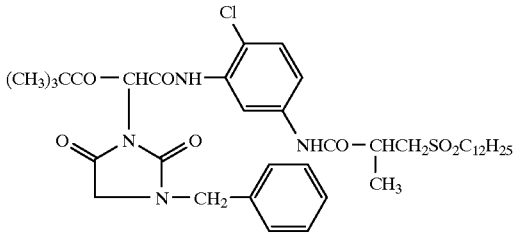
Y-2
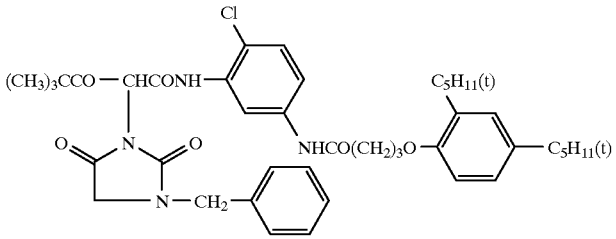
M-1
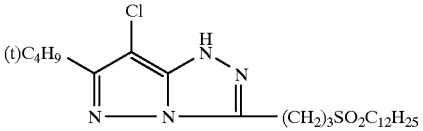
C-1
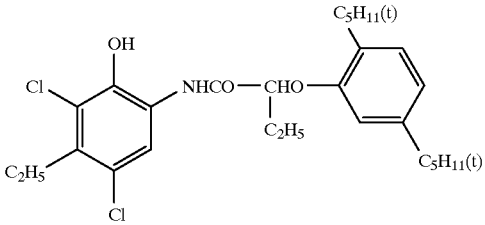
C-2
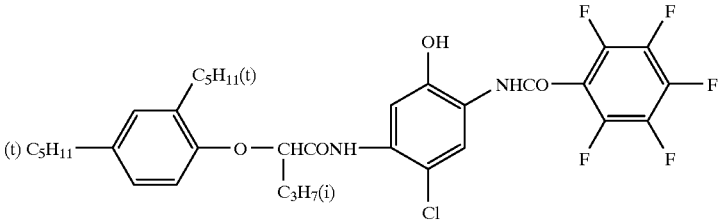
ST-1
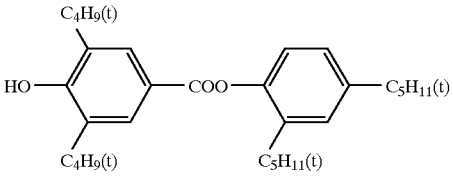
ST-2
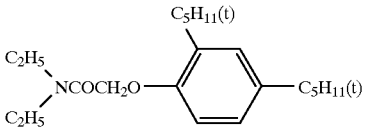
ST-3
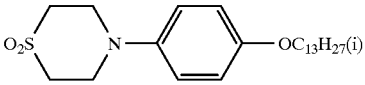
ST-4
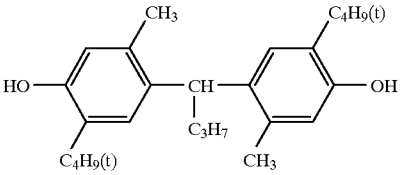
ST-5
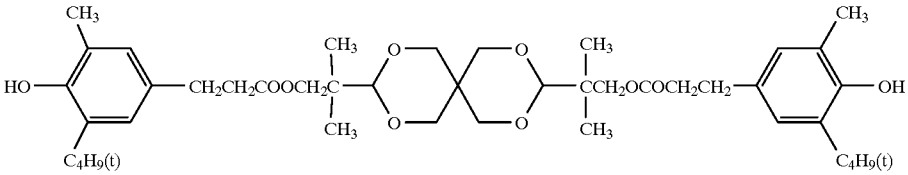
UV-1
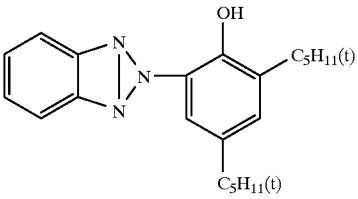
UV-2
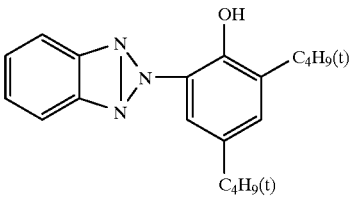

-continued

UV-3

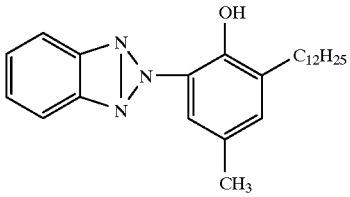

AI-1

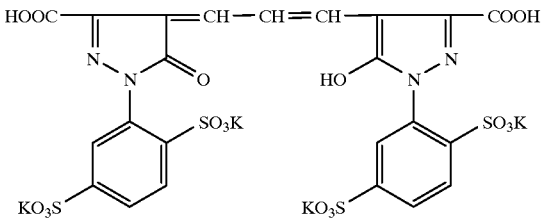

AI-2

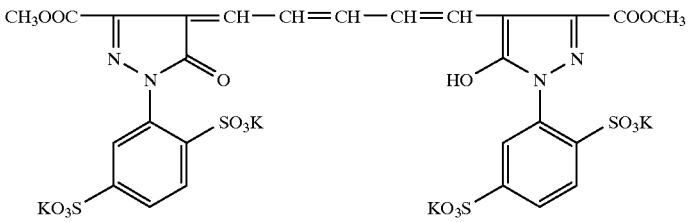

AI-3

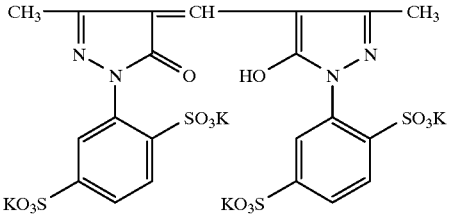

A mixture of

W-1

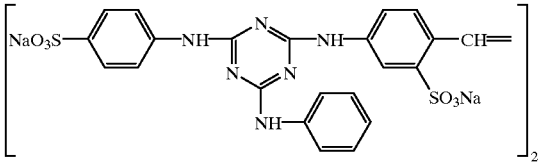

and

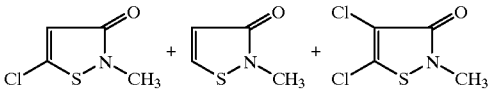

50% 46% 4% mole ratio (Preparation of blue sensitive silver halide emulsion)

To 1 liter of an aqueous 2% gelatin solution kept at 40° C., the following solutions A and B were simultaneously added in 30 minutes while controlling pAg at 7.3 and pH at 3.0. In addition, the following solutions C and D were added thereto in 180 minutes while controlling pAg at 8.0 and pH at 5.5. In this occasion, pH was regulated by a method described in Japanese Patent O.P.I. Publication No. 45437/1984, and pH was controlled by the use of sulfuric acid or an aqueous sodium hydroxide.

| (Solution A) | |
|---|---|
| Sodium chloride | 3.42 g |
| Potassium bromide | 0.03 g |
| Water was added to make 200 cc. | |

| (Solution B) | |
|---|---|
| Silver nitrate | 10 g |
| Water was added to make 200 cc. | |

| (Solution C) | |
|---|---|
| $K_2IrCl_6$ | $2 \times 10^{-8}$ mol/mol Ag |
| Sodium chloride | 102.7 g |
| $K_4Fe(CN)_6$ | $1 \times 10^{-5}$ mol/mol Ag |
| Potassium bromide | 1.0 g |

| (Solution D) | |
|---|---|
| Silver nitrate | 300 g |
| Water was added to make 600 cc. | |

After adding the above-mentioned solutions, the resulting mixture was subjected to desalting employing an aqueous 5% Demol solution (produced by Kao Atlass) and an aqueous 20% solution of magnesium sulfate content ratio was 99.5 mol %.

Following this, the resulting solution was mixed with an aqueous gelatin solution for obtaining a mono dispersed cubic emulsion EMP-1 wherein the average grain size was 0.85 μm, variation coefficient of grain size distribution was 0.07 and the silver chloride.

The above-mentioned EMP-1 was subjected to the most suitable chemical sensitization at 60° C. using the following compounds so that a blue-sensitive silver halide emulsion (Em-B) was obtained.

| | |
|---|---|
| Sodium thiosulfate | 0.8 mg/mol AgX |
| Chloro auric acid | 0.5 mg/mol AgX |
| Stabilizer STAB-3 | $8 \times 10^{-4}$ mol/mol AgX |
| Sensitizing dye BS-1 | $4 \times 10^{-4}$ mol/mol AgX |
| Sensitizing dye BS-1 | $1 \times 10^{-4}$ mol/mol AgX |

(Preparation of green sensitive silver halide emulsion)

In the same manner as in EMP-1 except that the addition times of Solutions A and B and Solutions C and D, monodispersed cubic emulsion EMP-2 having an average grain size of 0.43 μm, variation coefficient of 0.08 and silver chloride content of 99.5% was obtained.

The above-mentioned EMP-2 was subjected to the most suitable chemical sensitization at 55° C. using the following compounds so that a blue-sensitive silver halide emulsion (Em-G) was obtained.

| | |
|---|---|
| Sodium thiosulfate | 1.5 mg/mol AgX |
| Chloro auric acid | 1.0 mg/mol AgX |
| Stabilizer STAB-1 | $6 \times 10^{-4}$ mol/mol Agx |
| Stabilizer STAB-2 | $3 \times 10^{-4}$ mol/mol AgX |
| Sensitizing dye GS-1 | $4 \times 10^{-4}$ mol/mol AgX |

(Preparation of red sensitive silver halide emulsion)

In the same manner as in EMP-1 except that the addition times of Solutions A and B and Solutions C and D, monodispersed cubic emulsion EMP-3 having an average grain size of 0.50 μm, variation coefficient of 0.08 and silver chloride content of 99.5% was obtained.

The above-mentioned EMP-3 was subjected to the most suitable chemical sensitization at 60° C. using the following compounds so that a blue-sensitive silver halide emulsion (Em-R) was obtained.

| | |
|---|---|
| Sodium thiosulfate | 1.8 mg/mol AgX |
| Chloro auric acid | 2.0 mg/mol AgX |
| Stabilizer STAB-1 | $6 \times 10^{-4}$ mol/mol AgX |
| Stabilizer STAB-2 | $3 \times 10^{-4}$ mol/mol AgX |
| Sensitizing dye GS-1 | $1 \times 10^{-4}$ mol/mol AgX |
| Sensitizing dye GS-2 | $1 \times 10^{-4}$ mol/mol AgX |

STAB-1: 1-(3-acetoamidephenyl)-5-mercaptotetrazole
STAB-2: 1-phenyl-5-mercapto tetrazole
STAB-3: 1-(4-ethoxyphenyl)-5-mercapto tetrazole

BS-1

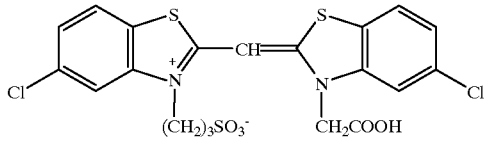

BS-2

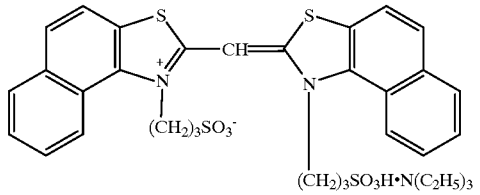

GS-1

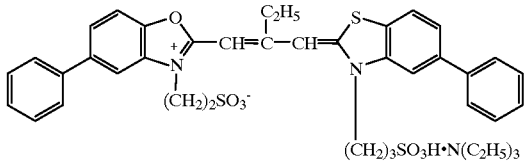

RS-1

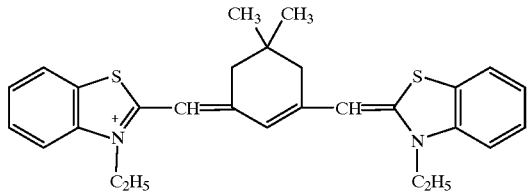

RS-2

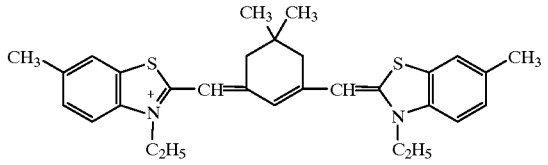

Samples 102 and 103 were prepared in the same manner as in Sample 101 except that an oil-soluble organic basic compound of the present invention was added in an amount as shown in Table 3 and was added to layers as shown in Table 3.

Samples thus prepared was subjected to wedge exposure to light by means a conventional method. Following this, by the use of a color paper processing machine, samples were subjected to color developing, bleach fixing and stabilizing process until the amount of bleach-fixing replenishing becomes 0.2 time of the volume of the tank per day and twice in total.

| Processing step | Processing Temperature | Time | Amount of Replenishing ($/m^2$) |
|---|---|---|---|
| Color developing | 38.0 ± 0.3° C. | 27 sec. | 80 cc |
| Bleach fixing | 38.0 ± 0.5° C. | 27 sec. | 80 cc |
| Stabilizing | 30–34° C. | 60 sec. | 120 cc |
| Drying | 60–80° C. | 30 sec. | |

The composition of photographic processing solution is shown as below:

| Tank solution and replenisher solution for color developing solution | | |
|---|---|---|
| | Tank solution | Replenisher solution |
| Deionized water | 800 cc | 800 cc |
| Triethylenediamine | 2 g | 3 g |
| Diethyleneglycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamideethyl)3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |

Water was added to make 1 liter in total. pH of the tank solution was regulated to 10.10, and that of the replenisher solution was regulated to 10.60

| Tank solution and replenisher solution for bleach-fixing solution | |
|---|---|
| Dihydrate ammonium ferric diethylenetriamine pentaacetic acid | 70 g |
| Diethylenetriamine pentaacetic acid | 3 g |
| Ammonium thiosulfate (70% aqueous solution) | 100 cc |
| 2-amino-5-mercapto-1,3,4-thiadiazole | 2.0 g |
| Ammonium sulfite (40% aqueous solution) | 27.5 cc |

Water was added to make 1 liter in total. pH was regulated to 5.0 with potassium carbonate or glacial acetic acid.

| Tank solution and replenisher solution for the stabilizer | |
|---|---|
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| Fluorescent brightening agent (Chinopal SFP) | 2.0 g |
| 1-hydroxyethylidene-1,1-diphosphonic acid | 1.8 g |
| Bismuth chloride (an aqueous 45% solution) | 0.65 g |
| 7 hydrate magnesium sulfate | 0.2 g |
| PVP | 1.0 g |
| An aqueous ammonia (an aqueous 25% ammonium hydroxide) | 2.5 g |
| Trisodium salt nitrilotriacetic acid | 1.5 g |

Water was added to make 1 liter in total. pH was regulated to 7.5 with sulfate and aqueous ammonia.

Density of silver ion of the bleach stabilizing method after continuous processing was finished was calculated by means of an atomic absorption method. As a result, the density was 0.065 mol per liter of the bleach-fixer. In addition, when the density of ferric complex was calculated by means of a coloring method using o-phenanthroline, it was 12%.

After the continuous processing was finished, pH of the bleach-fixing processing solution was changed as shown in Table 3. Each of light-sensitive material sample subjected to wedge exposure to light was processed according to the above-mentioned processing step. The maximum density ($D_{max}^R$) of each sample subjected to processing of the red sensitive emulsion layer was measured by means of a PDA-65 densitometer (produced by Konica)

Next, each sample subjected to processing was processed by means of the following processing solution and processing method. The maximum density after being processed was similarly measured. The difference of the maximum density ($\Delta D_{max}^R$) before and after processing was calculated and the recoloring property was evaluated. The smaller $\Delta D_{max}^R$ is, dye loss problem of the cyan dye image was improved.

Processing Solution

Water was added to 30 g of ammonium salt of ferric ethylenediamine tetraacetic acid to make 1 liter in total. The pH of the resulting solution was regulated to 7.0 with an aqueous ammonia.

Processing Method

For 5 minutes at 38° C.

Table 3 shows the results thereof.

TABLE 3

| | Oil-Soluble Organic Basic Compound | | | | Maximum | Dye loss |
|---|---|---|---|---|---|---|
| Sample No. | Kind | Added Amount* | Added Amount** | pH | Density ($D_{max}^R$) | Property ($\Delta D_{max}^R$) |
| 101 | — | — | — | 6.5 | 2.44 | 0.02 |
| | — | — | — | 6.0 | 2.42 | 0.03 |
| | — | — | — | 5.5 | 2.36 | 0.08 |
| | — | — | — | 5.0 | 2.27 | 0.17 |
| 102 | 13 | 5 | 5th layer | 6.5 | 2.46 | 0.00 |
| | 13 | 5 | 5th layer | 6.0 | 2.45 | 0.01 |
| | 13 | 5 | 5th layer | 5.5 | 2.45 | 0.01 |
| | 13 | 5 | 5th layer | 5.0 | 2.41 | 0.05 |
| 103 | 49 | 5 | 5th layer | 6.5 | 2.46 | 0.00 |
| | 49 | 5 | 5th layer | 6.0 | 2.45 | 0.01 |
| | 49 | 5 | 5th layer | 5.5 | 2.44 | 0.02 |
| | 49 | 5 | 5th layer | 5.0 | 2.42 | 0.04 |

*Represents mol ratio on the cyan coupler (C-1 + C-2).

**Added compounds were dissolved together with C-1 and C-2, and emulsified and dispersed.

As is apparent from Table 3, Samples 102 and 103 in which the compound of the present invention was added to the 5th layer in which the cyan coupler exists could improve the cyhan dye loss without reducing the maximum density in a region in which pH was 5.0–6.5.

EXAMPLE 2

Samples thus prepared was subjected to wedge exposure to light by means a conventional method. Following this, by the use of a color paper processing machine, samples were subjected to color developing, bleach fixing and stabilizing process until the amount of bleach-fixing replenishing becomes twice each volume of the tanks. The replenisher amount and processing amount per day were changed as shown in Table. 4

| Processing step | Processing Temperature | Time | Amount of Replenishing (/m$^2$) |
|---|---|---|---|
| Color developing | 39.0 ± 0.3° C. | 22 sec. | 80 cc |
| Bleach fixing | 39.0 ± 0.5° C. | 22 sec. | see Table 4 |
| Stabilizing | 30–34° C. | 45 sec. | 120 cc |
| Drying | 60–80° C. | 30 sec. | |

The composition of photographic processing solution is shown as below:

Tank Solution and Replenisher Solution for Color Developing Solution

Same as in Example 1 for both of the tank solution and the replenisher solution.

Tank solution and replenisher for bleach-fixing solution

| | Tank solution | Replenisher solution |
|---|---|---|
| Dihydrate ammonium ferric diethylenetriamine pentaacetic acid | 100 g | 50 g |
| Diethylenetriamine pentaacetic acid | 3 g | 3 g |
| Ammonium thiosulfate (70% aqueous solution) | 200 cc | 100 cc |
| 2-amino-5-mercapto-1,3,4-thiadiazole | 2.0 g | 1.0 g |
| Ammonium sulfite (40% aqueous solution) | 50 cc | 25 cc |

Water was added to make 1 liter in total. pH of the tank solution was regulated to 6.0 and pH of the replenisher solution was 5.5 with potassium carbonate or glacial acetic acid.

Tank solution and replenisher solution for the stabilizer

| | |
|---|---|
| o-phenylphenol | 1.0 g |
| 5-chloro-2-methyl-4-isothiazoline-3-on | 0.02 g |
| 2-methyl-4-isothiazoline-3-on | 0.02 g |
| Diethylene glycol | 1.0 g |
| Fluorescent brightening agent (Chinopal SFP) | 2.0 g |
| 1-hydroxyethylidene-1,1-diphosphonic acid | 1.8 g |
| PVP | 1.0 g |
| An aqueous ammonia (an aqueous 25% ammonium hydroxide) | 2.5 g |
| Ethylenediamine tetraacetic acid | 1.0 g |
| Ammonium sulfite (an aqueous 40% solution) | 10 cc |

Water was added to make 1 liter in total. pH was regulated to 7.5 with sulfate and aqueous ammonia.

Table 4 shows the results thereof.

As is apparent from Table 4, it can be understood that Samples 102 and 103 in which the compounds of the present invention have been added can improve insufficient cyan dye loss even when the density of silver ion and the density of ferric ion in the bleach-fixing solution.

In addition, the upper limit of the silver ion density and the ferric ion density (the ratio of ferric complex which occupies the total ion complex which reach substantially no problematic level by adding the compounds of the present invention was 0.11/liter for the former case and 35 wt % for the latter case.

EXAMPLE 3

Samples 301–326 in which the compounds of the present invention were emulsified and dispersed together with a hydrophobic components (couplers, high boiling solvents and dye image stabilizers) to be incorporated in a sample 101 used in Examples 1 and 2 in an added amount as shown in Table 5.

Samples thus prepared were subjected to wedge exposure to light in the same manner as in Example 1. Following this, Samples were subjected to similar processing as Example 2. pH of the bleach-fixing solution after continuous processing was regulated to 5.5. The amount of replenishing the bleach-fixing solution was 50 cc/m$^2$, and the processing amount per day was 0.1 time/tank volume.

In addition, degree of dispersion processability when emulsified using a ultrasonic homogenizer was evaluated in terms of 5 ranks at the final arrival turbidity (ppm). For measurement, integral spherical turbidity-meter, model SEP-PT-501D produced by Nippon Seimitsu Kogaku Co., Ltd. was used. Quartz cell having 0.3 mm thickness was used. Table 5 shows the results thereof.

A: less than 25 ppm

B: 25 ppm and more and less than 50 ppm

C: 50 ppm or more and less than 100 ppm

D: 100 ppm or more and less than 200 ppm

TABLE 4

| Sample No. | Organic Basic Compound | Replenishing Solution for Bleach-Fixing Solution (cc/m$^2$) | Daily Processing Amount (Times/Tank Volume) | Silver Ion Density (mol/L) | Ferrite Ion Density (wt %) | Recoloring Property ($\Delta D_{max}{}^{R}$) |
|---|---|---|---|---|---|---|
| 101 | — | 120 | 0.2 | 0.032 | 8 | 0.05 |
| | — | 80 | 0.1 | 0.068 | 11 | 0.11 |
| | — | 50 | 0.2 | 0.090 | 18 | 0.09 |
| | — | 50 | 0.1 | 0.093 | 16 | 0.19 |
| | — | 30 | 0.2 | 0.109 | 35 | 0.32 |
| | — | 20 | 0.2 | 0.117 | 40 | 0.34 |
| 102 | 13 | 120 | 0.2 | 0.032 | 8 | 0.01 |
| | 13 | 80 | 0.1 | 0.068 | 11 | 0.01 |
| | 13 | 50 | 0.2 | 0.090 | 18 | 0.03 |
| | 13 | 50 | 0.1 | 0.093 | 16 | 0.04 |
| | 13 | 30 | 0.2 | 0.109 | 35 | 0.07 |
| | 13 | 20 | 0.2 | 0.117 | 40 | 0.16 |
| 103 | 49 | 120 | 0.2 | 0.032 | 8 | 0.00 |
| | 49 | 80 | 0.1 | 0.068 | 11 | 0.01 |
| | 49 | 50 | 0.2 | 0.090 | 18 | 0.02 |
| | 49 | 50 | 0.1 | 0.093 | 16 | 0.04 |
| | 49 | 30 | 0.2 | 0.109 | 35 | 0.08 |
| | 49 | 20 | 0.2 | 0.117 | 40 | 0.15 |

E: 200 ppm or more

TABLE 5

| Sample No. | Oil-Soluble Organic Basic Compound Kind | Added Amount* | Added Amount** | Maximum Density ($D_{max}^R$) | Dye loss Property ($\Delta D_{max}^R$) | Dispersion Processability |
|---|---|---|---|---|---|---|
| 101 | — | — | — | 2.22 | 0.19 | A |
| 301 | 2 | 2 | 5th layer | 2.46 | 0.01 | A |
| 302 | 24 | 2 | 5th layer | 2.45 | 0.02 | A |
| 303 | 27 | 2 | 5th layer | 2.47 | 0.00 | A |
| 304 | 35 | 2 | 5th layer | 2.47 | 0.01 | A |
| 305 | 36 | 2 | 5th layer | 2.46 | 0.01 | A |
| 306 | 52 | 2 | 5th layer | 2.45 | 0.02 | A |
| 307 | 72 | 2 | 5th layer | 2.37 | 0.09 | A |
| 308 | 75 | 2 | 5th layer | 2.38 | 0.10 | A |
| 309 | 82 | 2 | 5th layer | 2.37 | 0.10 | A |
| 310 | 84 | 2 | 5th layer | 2.36 | 0.10 | A |
| 311 | 58 | 2 | 5th layer | 2.41 | 0.00 | B |
| 312 | 59 | 2 | 5th layer | 2.42 | 0.01 | B |
| 313 | 61 | 2 | 5th layer | 2.32 | 0.12 | A |
| 314 | 68 | 2 | 5th layer | 2.28 | 0.00 | B |
| 315 | 2 | 30 | 5th layer | 2.25 | 0.00 | C |
| 316 | 2 | 50 | 5th layer | 2.06 | 0.00 | D |
| 317 | 58 | 30 | 5th layer | 2.20 | 0.00 | C |
| 318 | 58 | 50 | 5th layer | 1.95 | 0.00 | D |
| 319 | 61 | 30 | 5th layer | 2.29 | 0.08 | B |
| 320 | 61 | 50 | 5th layer | 2.18 | 0.06 | C |
| 321 | 36 | 2 | 6th layer | 2.43 | 0.05 | A |
| 322 | 36 | 2 | 4th layer | 2.41 | 0.09 | A |
| 323 | 36 | 2 | 3rd layer | 2.38 | 0.16 | A |
| 324 | 91 | 2 | 5th layer | 2.44 | 0.02 | A |
| 325 | 91 | 30 | 5th layer | 2.50 | 0.01 | A |
| 326 | 91 | 50 | 5th layer | 2.30 | 0.01 | B |

*represents mol ratio on the cyan coupler (C-1 + C-2).
**Added compounds were dissolved together with C-1 and C-2, and emulsified and dispersed.

As is apparent from Table 5, Samples 301 through 326 noticeably improved insufficient cyan dye loss compared with Sample 101 of Comparative sample. Of these, Samples 301 through 306, 311, 312, 324 and 325 respectively employing compounds 2, 24, 27, 35, 36, 52, 58, 59 and 91 of the present invention provided high maximum coloring density and favorable dispersion processability.

In addition, in Samples 301, 315 and 316 respectively employing compound 2 of the present invention, in spite of enhancing the added amount of Compound 2, the dye loss property is not changed relatively. However, it was found that the dispersion processability was deteriorated, and the maximum coloring density tended to be reduced. Such tendency was observed between Samples 311, 317 and 318 and 313, 319 and 320. It was found that the added amount of 30 mol % was generally the most preferable.

However, when compound 91 of the present invention represented by Formula (IV) was employed, it was found that deterioration of dispersion processability and reduction of the maximum coloring density due to enhancement of the added amount were small.

Due to comparison of Samples 305, 321 and 323, layers in which the compound of the present invention is added are the fifth layer containing a cyan coupler, the 6th layer which is an adjoining layer thereof and the fourth layer are preferable. It was found that the fifth layer was the most effective.

EXAMPLE 4

Samples 101 through 103 employed in Examples 1 and 2 and Sample 311 employed in Example 3 were subjected to wedge exposure to light as in the same manner as in Example 1. Following this, employing the same processing solution except that benzyl alcohol of 15 cc per liter was added to the color developing tank and the replenisher tank respectively used in Example 1. The value of pH of the bleach-fixing solution of continuous processing was regulated to 5.5. The replenisher amount of the bleach-fixing was 50 cc/m$^2$ and daily processing amount was 0.1 time/tank volume.

The maximum color developing density ($D_{max}^R$) and recoloring property ($\Delta D_{max}^R$) in the red sensitive emulsion layer in each sample were measured by the same method as in Example 1. The results thereof are shown below:

| Sample No. | Oil-soluble organic basic compounds | Maximum density ($D_{max}^R$) | Dye loss property ($\Delta D_{max}^R$) |
|---|---|---|---|
| 101 | — | 2.41 | 0.21 |
| 102 | 13 | 2.43 | 0.12 |
| 103 | 49 | 2.44 | 0.11 |
| 311 | 58 | 2.42 | 0.14 |

As is apparent from the results, in the color developing solution in which benzyl alcohol was added, insufficient dying was improved due to the compound of the present invention, the width of improvement was smaller compared with a case when a color developing solution not containing benzyl alcohol. In addition, the width of the rise of the maximum density was also small. Namely, it is found that the oil-soluble organic basic compound of the present invention can effect more effectively compared with a case when a color developing solution not containing benzyl alcohol is not contained.

EXAMPLE 5

Samples 501–503 in which the compound of the present invention and the compound B of Comparative sample were added by 10 mol % per the cyan coupler in Sample 101 used in Examples 1 and 2 and in aforesaid 5th layer of Sample 101. Aforesaid samples were subjected to the same processing as in Example 3, and their maximum color developing density ($\Delta D_{max}^R$) and the dye loss property ($\Delta D_{max}^R$) were measured. The results will be exhibited together with the oil pH variation value ($\Delta$pH) of the compound.

| Sample No. | Oil-soluble organic basic compound | Maximum density ($\Delta D_{max}^R$) | Dye loss property ($\Delta D_{max}^R$) | ΔpH |
|---|---|---|---|---|
| 101 | — | 2.22 | 0.19 | — |
| 501 | 58 | 2.27 | 0.00 | +4.75 |
| 502 | 62 | 2.42 | 0.10 | +0.10 |
| 503 | B | 2.25 | 0.19 | +0.02 |

Compound B

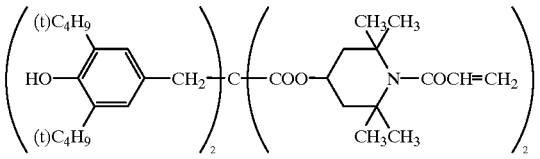

It was found that the oil-soluble organic basic compound in which oil pH variation value was 0.10 or more is effective for improvement of dying property.

A reflective support which is the same as in Example 1 was prepared. After providing aforesaid support with corona discharge, a gelatin subbing layer was provided. On aforesaid subbing layer, each layer having a constitution as shown in Tables 6 and 7 were coated. Thus, light-sensitive material 601 was prepared. The coating composition was prepared as below.

Coating Composition for the 1st Layer

To 23.4 g of yellow coupler (Y-3), 3.34 g of dye image stabilizer (ST-1), 3.34 g of ST-2, 3.34 g of ST-5, 0.34 g of anti-stain agent (HQ-1), 5.0 g of image stabilizer A, 3.33 g of high boiling organic solvent (DBP) and 1.67 g of DNP, 60 cc of ethyl acetic acid was added to be dissolved. Aforesaid solution was emulsified and dispersed in 220 cc of an aqueous 10% gelatin solution containing 7 cc of 20% surfactant (SU-1) using a ultrasonic homogenizer to prepare yellow coupler dispersing solution. This dispersed solution was mixed with a blue sensitive silver halide emulsion prepared under the following conditions for preparing a coating composition for the 1st layer.

Coating compositions for the 2nd layer through 7th layer were also prepared in the same manner as in the above-mentioned coating composition for the 1st layer in which the coated amount was shown in Tables 6 and 7.

As hardeners, H-1 and H-2 were added. As coating aids, surfactants SU-2 and SU-3 were added to adjust surface tension. In addition, F-1 was added in such a manner that the total amount would be 0.04 g/m$^2$.

TABLE 6

| Layer | Constitution | Amount (g/m$^2$) |
|---|---|---|
| 7th layer (Protective layer) | Gelatin | 1.00 |
| | DIDP | 0.002 |
| | DBP | 0.002 |
| | Silicone dioxide | 0.003 |
| 6th layer (UV absorber) | Gelatin | 0.40 |
| | AI-4 | 0.01 |
| | UV absorber (UV-1) | 0.12 |
| | UV absorber (UV-2) | 0.04 |
| | UV absorber (UV-3) | 0.16 |
| | Anti-stain agent (HQ-5) | 0.04 |
| | PVP | 0.03 |
| 5th layer (Red sensitive layer) | Gelatin | 1.30 |
| | Red sensitive silver bromochloride emulsion (Em-R') | 0.21 |
| | Cyan coupler (C-1) | 0.25 |
| | Cyan coupler (C-3) | 0.08 |
| | Dye image stabilizer (ST-1) | 0.10 |
| | Anti-stain agent (HQ-1) | 0.004 |
| | DBP | 0.10 |
| | DOP | 0.20 |

TABLE 7

| Layer | Composition | Amount (g/m$^2$) |
|---|---|---|
| 4th layer (UV absorber) | Gelatin | 0.94 |
| | UV absorber (UV-1) | 0.28 |
| | UV absorber (UV-2) | 0.09 |
| | UV absorber (UV-3) | 0.38 |
| | AI-4 | 0.02 |
| | Anti-stain agent (HQ-5) | 0.10 |
| 3rd layer (Green sensitive layer) | Gelatin | 1.30 |
| | AI-5 | 0.01 |
| | Green sensitive silver bromochloride emulsion (Em-G') | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |
| 2nd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.04 |
| | DBP | 0.02 |
| | Fluorescent brightening agent (W-1) | 0.10 |
| 1st layer (Blue sensitive layer) | Gelatin | 1.20 |
| | Blue sensitive silver bromochloride emulsion (Em-B') | 0.26 |
| | Yellow coupler | 0.70 |
| | Dye image stabilizer (ST-1) | 0.10 |
| | Dye image stabilizer (ST-2) | 0.10 |
| | Dye image stabilizer (ST-5) | 0.10 |
| | Anti-stain agent (HQ-1) | 0.01 |
| | Image stabilizer A | 0.15 |
| | DNP | 0.05 |
| | DBP | 0.15 |
| Support | Polyethylene-laminated paper (containing fine amount of colorant) | |

Amount of silver halide emulsion was represented in conversion to silver.

Image stabilizer A: p-t-octyl phenol

Y-3

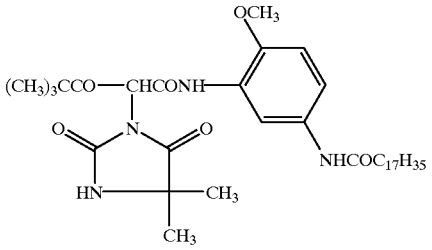

C-3

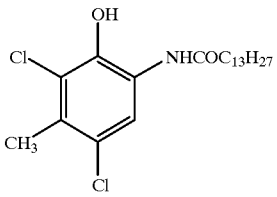

-continued

Al-4

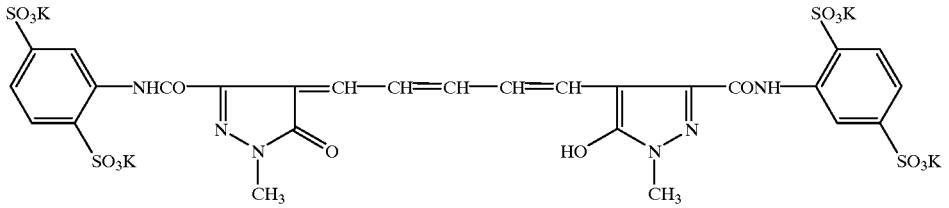

Al-5

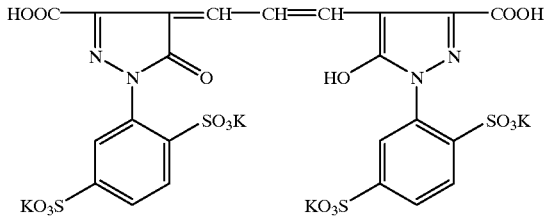

(Preparation of blue sensitive silver halide emulsion)

To 1 liter of an aqueous 2% gelatin solution kept at 40° C., the following solutions A' and B' were added simultaneously in 30 minutes while controlling pAg at 7.3 and pH at 3.0. Following this, to the above-mentioned mixture, the following solutions C' and D' were also added simultaneously in 180 seconds. In this occasion, pAg was controlled by means of a method described in Japanese Patent O.P.I. Publication No. 59-45437, and pH was controlled using sulfuric acid or an aqueous sodium hydroxide solution.

| Solution A' | |
|---|---|
| Sodium chloride | 3.42 g |
| Potassium bromide | 0.03 g |
| Water was added to make 200 cc in total. | |

| Solution B' | |
|---|---|
| Silver nitrate | 10 g |
| Water was added to make 200 cc in total. | |

| Solution C' | |
|---|---|
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Water was added to make 600 cc in total. | |

| Solution D' | |
|---|---|
| Silver nitrate | 300 g |
| Water was added to make 600 cc in total. | |

After adding the above-mentioned solutions, the resulting mixture was subjected to desalting employing an aqueous 5% Demol solution (produced by Kao Atlass) and an aqueous 20% solution of magnesium sulfate. Following this, the resulting solution was mixed with an aqueous gelatin solution for obtaining a mono dispersed cubic emulsion EMP-1' wherein the average grain size was 0.85 μm, variation coefficient of grain size distribution was 0.07 and the silver chloride content ratio was 99.5 mol %.

In the same manner as in EMP-1' except that the addition times of Solutions A' and B' and Solutions C' and D', mono-dispersed cubic emulsion EMP-1'B having an average grain size of 0.64 μm, variation coefficient of 0.07 and silver chloride content of 99.5% was obtained.

The above-mentioned EMP-1' was subjected to the most suitable chemical sensitization at 60° C. using the following compounds. In addition, EMP-1'B was subjected to the most suitable chemical sensitization. Following this, EMP-1' and EMP-1'B were mixed in a ratio of 1:1 in terms of silver. Thus, a blue sensitive silver halide emulsion (Em-B') was obtained.

| | |
|---|---|
| Sodium thiosulfate | 0.8 mg/mol AgX |
| Chloro auric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

(Preparation of green sensitive silver halide emulsion)

In the same manner as in EMP-1 except that the addition times of Solutions A' and B' and Solutions C' and D' were changed, mono-dispersed cubic emulsion EMP-2' having an average grain size of 0.40 μm, variation coefficient of 0.08 and silver chloride content of 99.5% was obtained.

Next, mono-dispersed cubic emulsion EMP-2'B whose average grain side of 0.50 μm, variation coefficient of 0.08 and silver chloride content of 99.5% was obtained.

The above-mentioned EMP-2' was subjected to the most suitable chemical sensitization at 55° C. using the following compounds. In addition, EMP-2'B was subjected to the most suitable chemical sensitization. Following this, EMP-2' and EMP-2'B were mixed in a ratio of 1:1 in terms of silver. Thus, a green sensitive silver halide emulsion (Em-G') was obtained.

| | |
|---|---|
| Sodium thiosulfate | 1.5 mg/mol AgX |
| Chloro auric acid | 1.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye GS-1 | $4 \times 10^{-4}$ mol/mol AgX |

(Preparation of red sensitive silver halide emulsion)

In the same manner as in EMP-1' except that the addition times of Solutions A' and B' and Solutions C' and D' were changed, mono-dispersed cubic emulsion EMP-3' having an average grain size of 0.40 μm, variation coefficient of 0.08 and silver chloride content of 99.5% was obtained, and mono-dispersed cubic emulsion EMP-3'B having an average grain size of 0.38 μm, variation coefficient of 0.08 and silver chloride content of 99.5% was obtained.

The above-mentioned EMP-3' was subjected to the most suitable chemical sensitization at 55° C. using the following compounds. In addition, EMP-3'B was subjected to the most suitable chemical sensitization. Following this, EMP-3' and EMP-3'B were mixed in a ratio of 1:1 in terms of silver. Thus, a red sensitive silver halide emulsion (Em-R') was obtained.

| | |
|---|---|
| Sodium thiosulfate | 1.8 mg/mol AgX |
| Chloro auric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |

To the red sensitive emulsion, SS-1 was added by $2.0 \times 10^{-3}$ mol per mol of silver halide.

SS-1

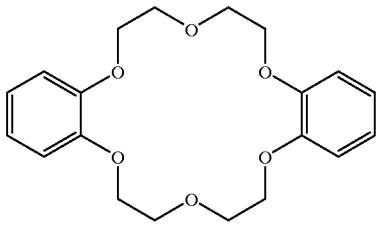

In place of Sample 601 having dye image stabilizers (ST-1, ST-2 and ST-5) in the first layer, Samples 602 through 621 in which the compounds of the present invention and the compounds of the comparative sample whose sum of mol number is equivalent to aforesaid stabilizers were prepared.

Each sample thus prepared was subjected to wedge exposure to blue light. Following this, the samples were subjected to photographic processing by means of the following steps.

| Processing step | Processing temperature | Time | Replenishing amount (/m$^2$) |
|---|---|---|---|
| Color developing | 38.0 ± 0.3° C. | 45 sec. | 80 cc |
| Bleach fixing | 35.0 ± 0.5° C. | 45 sec. | 120 cc |

-continued

| Processing step | Processing temperature | Time | Replenishing amount (/m$^2$) |
|---|---|---|---|
| Stabilizing | 30–34° C. | 60 sec. | 150 cc |
| Drying | 60–80° C. | 30 sec. | |

Composition of photographic processing solutions (the color developing solution tank solution and its replenishing solution, the bleach-fixing solution tank solution and its replenishing solution and the stabilizing solution tank solution and its replenishing solution) are the same as in Example 1.

With regard to a processed color samples, a coloring property, a light fastness, a dark fading color property dispersion processability of a yellow coupler dispersion solution and its aging stability were evaluated as follows:

Blue light reflective density ($D^B_{max}$) of the maximum density portion of each sample was measured by means of a densitometer model PDA-65 (produced by Konica Corporation), the results were used as a target of coloring property.

<Light fastness>

Each sample was subjected to light irradiation for 450 hours in a Xenon fademeter of 70,000 lux. Light fastness was evaluated from the color fading ratio (%) after 450 hours. The color fading ratio was calculated in the following manner.

Color fading ratio (%)=(Do−D/Do)×100 wherein Do=density before light irradiation (1.0)
D=density after light irradiation <Dark fading property>

Each sample was stored in a temperature-constant apparatus at 85° C. and 60% RH for 20 days. The dark fading property was evaluated from the color fading ratio (%) after 20 days. Calculation method of the fading ratio is the same as that of light fastness.

<Dispersion processability of a dispersion solution>

Dispersion processability of a dispersion solution when it is emulsified and dispersed using a ultrasonic homogenizer was evaluated in terms of the final arrival turbidity (ppm). In measurement, an integral spherical type turbidity meter model SEP-PT-501D produced by Nippon Seimitsu Kogaku Co., Ltd. was used, and a quartz cell having 0.3 mm thickness was used.

<Aging stability of the dispersion solution>

The dispersion solution was stored under stirring at 50° C. for 24 hours. The aging stability was evaluated from the degree of rise (Δppm) of the turbidity before and after storage.

Table 8 shows the results thereof.

TABLE 8

| Sample No. | 1st Layer Dye Image | $D_{max}^{B}$ | Light-Fastness Stabilizer Color Fading Ratio (%) | Dark Color Fading Ratio (%) | Dispersion Processability Turbidity (ppm) | Aging Stability of Dispersion ΔTurbidity (ppm) |
|---|---|---|---|---|---|---|
| 601 | ST-1, ST-2, ST-5 | 2.15 | 70.2 | 80.8 | 9.8 | 15 |
| 602 | — | 2.12 | 47.7 | 79.4 | 7.3 | 10 |
| 603 | Compound-1 of the Comparative Inv. | 1.20 | 73.5 | 89.6 | 89 | 255 |
| 604 | Compound-2 of the Comparative Inv. | 1.23 | 72.9 | 88.8 | 78 | 201 |
| 605 | Compound-3 of the Comparative Inv. | 1.51 | 73.0 | 85.9 | 51 | 139 |
| 606 | Compound-4 of the Comparative Inv. | 1.71 | 72.4 | 81.8 | 43 | 105 |
| 607 | Compound-5 of the Comparative Inv. | 2.00 | 70.0 | 80.2 | 15 | 34 |
| 608 | Compound-6 of the Comparative Inv. | 2.10 | 71.0 | 80.8 | 8.9 | 14 |
| 609 | Compound-7 of the Comparative Inv. | 1.48 | 71.5 | 88.7 | 64 | 125 |
| 610 | Compound-8 of the Comparative Inv. | 1.55 | 70.9 | 89.4 | 70 | 108 |
| 611 | Compound-9 of the Comparative Inv. | 0.70 | — *1 | — *1 | 8.5 | 15 |
| 612 | 92 | 2.40 | 76.8 | 92.5 | 8.3 | 10 |
| 613 | 97 | 2.20 | 75.5 | 89.1 | 12.5 | 13 |
| 614 | 101 | 2.33 | 75.7 | 89.5 | 8.0 | 9 |
| 615 | 104 | 2.16 | 73.1 | 84.8 | 12.9 | 14 |
| 616 | 110 | 2.20 | 74.0 | 83.3 | 9.1 | 11 |
| 617 | 113 | 2.15 | 73.5 | 85.0 | 10 | 12 |
| 618 | 117 | 2.30 | 74.7 | 85.3 | 9.9 | 11 |
| 619 | 118 | 2.30 | 75.0 | 83.5 | 8.1 | 12 |
| 620 | 126 | 2.44 | 74.8 | 89.8 | 10 | 13 |
| 621 | 138 | 2.18 | 73.4 | 83.2 | 12 | 13 |

*1 Coloring density was too low to be measured.

Compound of the comparative sample-1

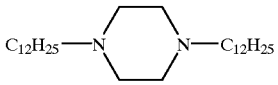

Compound described in Japanese Patent O.P.I. Publication No. 61-189539

Compound of the comparative sample-2

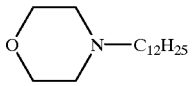

Compound described in Japanese Patent O.P.I. Publication No. 61-189539

Compound of the comparative sample-3

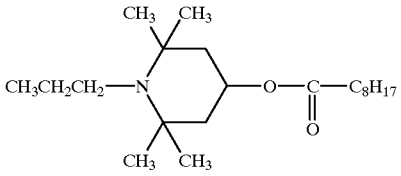

Compound described in Japanese Patent O.P.I. Publication No. 58-102231

Compound of the comparative sample-4

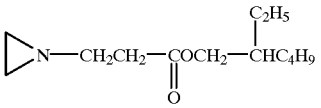

Compound described in Japanese Patent O.P.I. Publication No. 59-229557

Compound of the comparative sample-5

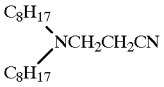

Compound described in Japanese Patent O.P.I. Publication No. 59-229557

Compound of the comparative sample-6

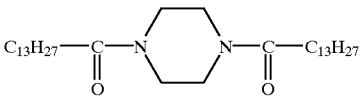

Compound described in Japanese Patent O.P.I. Publication No. 2-262654

Compound of the comparative sample-7

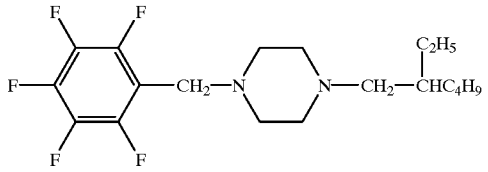

Compound described in Japanese Patent O.P.I. Publication No. 2-34837

Compound of the comparative sample-8

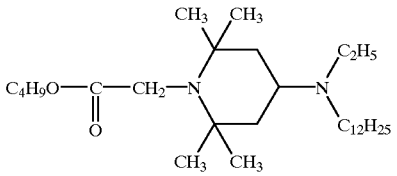

Compound described in Japanese Patent O.P.I. Publication No. 58-102231

Compound of the comparative sample-9

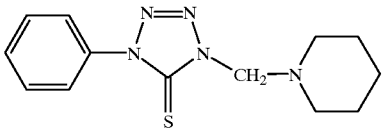

Compound described in Japanese Patent O.P.I. Publication No. 59-229557

As is apparent from Table 8, among compounds of the comparative sample having similar structures as compounds of the present invention, compounds of the comparative sample Nos. 1, 2 and 3 (Sample 603, 604 and 605) have too strong basicity. Accordingly, dispersion does not advance sufficiently. In addition, coloring property ($D^B_{max}$) is also low. Further, aging stability of the dispersion solution is extremely poor.

Compared with Samples 603, 604 and 605, compound 4 of the comparative sample (Sample 606) having a nitrogen-containing 3-member cyclic structure has been slightly improved in terms of dispersion processability, coloring property and aging stability of the dispersion solution. However, compared with Sample 601, 606 is extremely insufficient. In addition, light fastness, dark fading property has extremely small improvement effects. In addition, compared with Sample 601, compound of the comparative sample 5 (Sample 607) has a little deterioration in terms of dispersion processability, coloring property and aging stability of the dispersion solution. However, improvement in terms of light fastness and dark fading property have not been found.

On the other hand, in the case of a compound 6 of the comparative sample having 1,4-diacylpyperadine structure, dispersion processability and aging stability of the dispersion solution are favorable since aforesaid compound itself is neutral. In addition, reduction in terms of coloring property is small. However, improvement effects in terms of light fastness and dark fading property were extremely little. Compounds 7 and 8 of the comparative sample (in the case of compound 7 of the comparative sample, an amino group inside the cycle has been substituted with an alkyl group. In the case of a compound 8 of the comparative sample, a basic amino group is substituted with a pyperidine ring) could obtain similar results as Samples 604, 605 and 606.

With regard to compound 9 of the comparative sample, since oil solubility is low and a group capable of inhibiting development is included while interacting with a silver halide emulsion, sufficient coloring density could not be obtained and light fastness and dark fading property could not be evaluated.

On the contrary, in the case of any of Samples 612 through 621 employing a compound of the present invention, deterioration was not observed in terms of dispersion stability and aging stability of the dispersion solution. In addition, coloring property was slightly improved. Further, noticeable improvement effects were observed in both of light fastness and dark fading property.

EXAMPLE 7

On a triacetyl cellulose film support provided with a subbing layer, each layer having the following composition was formed in this order from the support so that multi-layered color photographic light-sensitive material sample 701 was prepared.

Added amount represents gram number per $m^2$, unless otherwise specified. In addition, silver halide and colloidal silver were represented in conversion to silver. Sensitizing dyes were represented by mol per mol of silver in the same sensitive layer.

| | |
|---|---|
| 1st layer: Anti-halation layer | |
| Black color colloidal silver | 0.16 |
| UV absorber (UV-11) | 0.20 |
| High boiling organic solvent (Oil-1) | 0.12 |
| Gelatin | 1.53 |
| 2nd layer: Intermediate layer | |
| Anti-color stain agent (SC-1) | 0.06 |
| High boiling organic solvent (Oil-2) | 0.08 |
| Gelatin | 0.80 |
| 3rd layer: Low sensitive red sensitivity layer | |
| Silver bromoiodide emulsion (the average grain size of 0.38 μm and silver iodide content of 8.0 mol %) | 0.43 |
| Silver bomoiodide emulsion (the average grain size of 0.27 μm and silver iodide content of 2.0 mol %) | 0.15 |
| Sensitizing dye (SD-1) | $2.8 \times 10^{-4}$ |
| Sensitizing dye (SD-2) | $1.9 \times 10^{-4}$ |
| Sensitizing dye (SD-3) | $1.9 \times 10^{-4}$ |
| Sensitizing dye (SD-4) | $1.0 \times 10^{-4}$ |
| Cyan coupler (C-11) | 0.56 |
| Colored cyan coupler (CC-1) | 0.021 |
| DIR compound (D-1) | 0.025 |
| High boiling solvent (Oil-1) | 0.49 |
| Gelatin | 1.14 |
| 4th layer: Middle sensitive red sensitivity layer | |
| Silver bromoiodide emulsion (the average grain size of 0.52 μm and silver iodide content of 8.0 mol %) | 0.89 |
| Silver bromoiodide emulsion (the average grain size of 0.38 μm and silver iodide content of 8.0 mol %) | 0.22 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-4}$ |
| Cyan coupler (C-11) | 0.45 |
| Colored cyan coupler (CC-1) | 0.038 |
| DIR compound (D-1) | 0.017 |
| High boiling solvent (Oil-1) | 0.39 |
| Gelatin | 1.01 |
| 5th layer: High sensitive red sensitivity layer | |
| Silver bromoiodide emulsion (the average grain size | 1.27 |

-continued

| | |
|---|---|
| of 1.00 μm and silver iodide content of 8.0 mol %) | |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-4}$ |
| Cyan coupler (C-12) | 0.20 |
| Colored cyan coupler (CC-1) | 0.034 |
| DIR compound (D-3) | 0.001 |
| High boiling solvent (Oil-1) | 0.57 |
| Gelatin | 1.10 |
| 6th layer: Intermediate layer | |
| Anti-color stain agent (SC-1) | 0.075 |
| High boiling solvent (Oil-2) | 0.095 |
| Gelatin | 1.00 |
| 7th layer: Intermediate layer | |
| Gelatin | 0.45 |
| 8th layer: Low sensitive green sensitivity layer | |
| Silver bromoiodide emulsion (the average grain size of 0.38 μm and silver iodide content of 8.0 mol %) | 0.64 |
| Silver bromoiodide emulsion (the average grain size of 0.27 μm and silver iodide content of 2.0 mol %) | 0.21 |
| Sensitizing dye (SD-1) | $7.4 \times 10^{-4}$ |
| Sensitizing dye (SD-5) | $6.6 \times 10^{-4}$ |
| Magenta coupler (M-11) | 0.19 |
| Magenta coupler (M-12) | 0.49 |
| Colored magenta coupler (CM-1) | 0.12 |
| High boiling solvent (Oil-2) | 0.81 |
| Gelatin | 1.89 |
| 9th layer: Middle sensitive green sensitivity layer | |
| Silver bromoiodide emulsion (the average grain size of 0.59 μm and silver iodide content of 8.0 mol %) | 0.76 |
| Sensitizing dye (SD-6) | $1.5 \times 10^{-4}$ |
| Sensitizing dye (SD-7) | $1.6 \times 10^{-4}$ |
| Sensitizing dye (SD-8) | $1.5 \times 10^{-4}$ |
| Magenta coupler (M-11) | 0.043 |
| Magenta coupler (M-12) | 0.10 |
| DIR compound (D-2) | 0.021 |
| DIR compound (D-3) | 0.002 |
| Colored magenta coupler (CM-2) | 0.039 |
| High boiling solvent (Oil-2) | 0.69 |
| Gelatin | 0.76 |
| 10th layer: High sensitive green sensitivity layer | |
| Silver bromoiodide emulsion (the average grain size of 1.00 μm and silver iodide content of 8.0 mol %) | 1.46 |
| Sensitizing dye (SD-6) | $0.93 \times 10^{-4}$ |
| Sensitizing dye (SD-7) | $0.97 \times 10^{-4}$ |
| Sensitizing dye (SD-8) | $0.93 \times 10^{-4}$ |
| Magenta coupler (M-11) | 0.08 |
| Magenta coupler (M-12) | 0.133 |
| Colored magenta coupler (CM-2) | 0.014 |
| High boiling solvent (Oil-1) | 0.15 |
| High boiling soivent (Oil-2) | 0.42 |
| Gelatin | 1.08 |
| 11th layer: Yellow filter layer | |
| Yellow colloidal silver | 0.07 |
| Anti-color stain agent (SC-1) | 0.18 |
| Formalin scavenger (HS-1) | 0.14 |
| High boiling solvent (Oil-2) | 0.21 |
| Gelatin | 0.73 |
| 12th layer: Intermediate layer | |
| Formalin scavenger (HS-1) | 0.18 |
| Gelatin | 0.60 |
| 13th layer: Low sensitive blue sensitivity layer | |
| Silver bromoiodide emulsion (the average grain size of 0.59 μm and silver iodide content of 8.0 mol %) | 0.073 |
| Silver bromoiodide emulsion (the average grain size of 0.38 μm and silver iodide content of 3.0 mol %) | 0.16 |
| Silver bromoiodide emulsion (the average grain size of 0.27 μm and silver iodide content of 2.0 mol %) | 0.20 |
| Sensitizing dye (SD-9) | $2.1 \times 10^{-4}$ |
| Sensitizing dye (SD-10) | $2.8 \times 10^{-4}$ |
| Yellow coupler (Y-11) | 0.89 |

-continued

| | |
|---|---|
| DIR compound (D-4) | 0.008 |
| High boiling solvent (Oil-2) | 0.37 |
| Gelatin | 1.51 |
| 14th layer: High sensitive blue sensitivity layer | |
| Silver bromoiodide emulsion (the average grain size of 1.00 μm and silver iodide content of 8.0 mol %) | 0.95 |
| Sensitizing dye (SD-9) | $7.3 \times 10^{-4}$ |
| Sensitizing dye (SD-10) | $2.8 \times 10^{-4}$ |
| Yellow coupler (Y-11) | 0.16 |
| High boiling solvent (Oil-2) | 0.093 |
| Gelatin | 0.80 |
| 15th layer: First protective layer | |
| Silver bromoiodide emulsion (the average grain size of 0.05 μm and silver iodide content of 3.0 mol %) | 0.30 |
| UV absorber (UV-11) | 0.094 |
| UV absorber (UV-12) | 0.10 |
| Formalin scavenger (HS-1) | 0.38 |
| High boiling solvent (Oil-1) | 0.10 |
| Gelatin | 1.44 |
| 16th layer: Second protective layer | |
| Alkali-soluble matted agent PM-1 (the average grain size of 2 μm) | 0.15 |
| Polymethylmethacrylate (the average grain size of 3 μm) | 0.04 |
| Lubricant (WAX-1) | 0.02 |
| Gelatin | 0.55 |

In addition to the above-mentioned components, coating aids SU-11, SU-12 and SU-13, dispersion aid SU-14, hardeners H-11 and H-12, viscosity regulator V-1, stabilizer ST-11, dyes AI-11 and AI-12, anti-foggant agent AF-1, two kind of polyvinyl pyrrolidone (AF-2) in which the molecular weight by weights were respectively 10,000 and 100,000 and anti-mildew agent DI-1 were added. The added amount of DI-1 was 9.4 mg/m$^2$ The compounds used for the above-mentioned samples are shown as below:

SU-11: Sodium salt of dioctyl sulfosuccinic acid

SU-12: $C_8H_{17}SO_2N(C_3H_7)CH_2COOK$

SU-13: $C_3H_{17}SO_2NH(CH_2)_3N_+(CH_3)_3Br^-$

SU-14: The same as SU-1 in Example 1

H-11: The same as H-2 in Example 1

H-12: $[(CH_2{=}CHSO_2CH_2)_3CCH_2SO_2CH_2CH_2]_2NCH_2CH_2SO_3Na$

ST-11: 4-hydroxy-6-methyl-1,3,3a,7-tetrazaindene

AF-1: 1-phenyl-5-mercaptotetrazole

DI-1: The same as F-1 in Example 1

Oil-1: The same as DOP in Example 1

Oil-2: Tricresylphosphate

SC-1: The same as HQ-1 in Example 1.

HS-1: Hydantoin

C-11
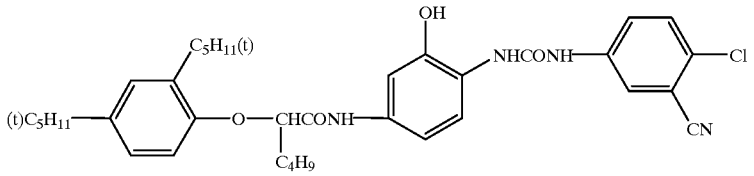
C-12
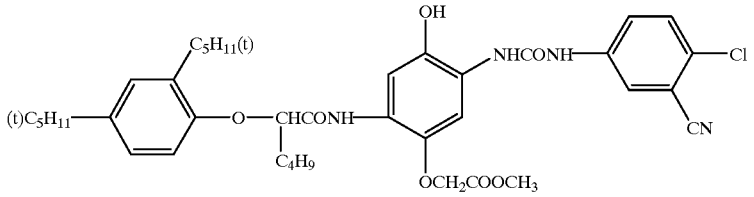
M-11
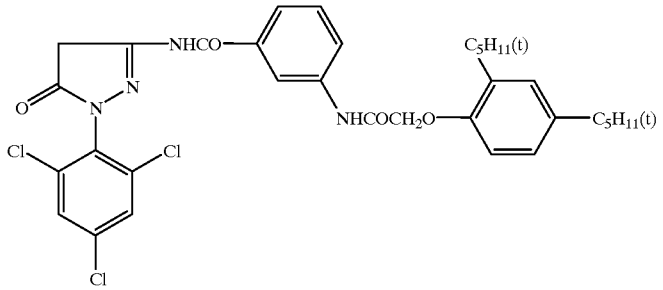
M-12
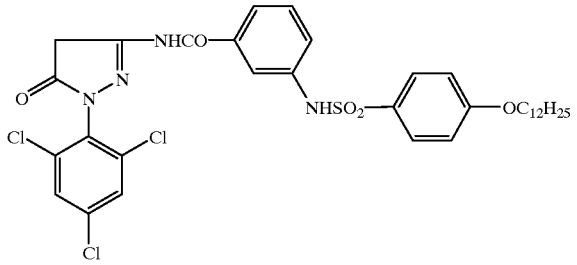
M-13
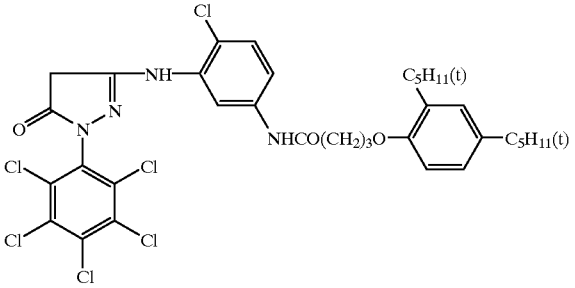
Y-11
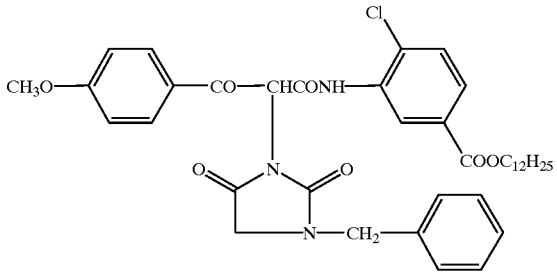
CC-1
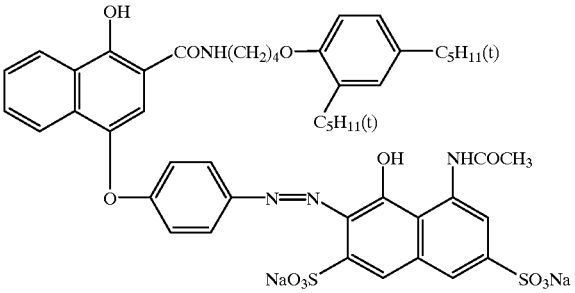

-continued
CM-1
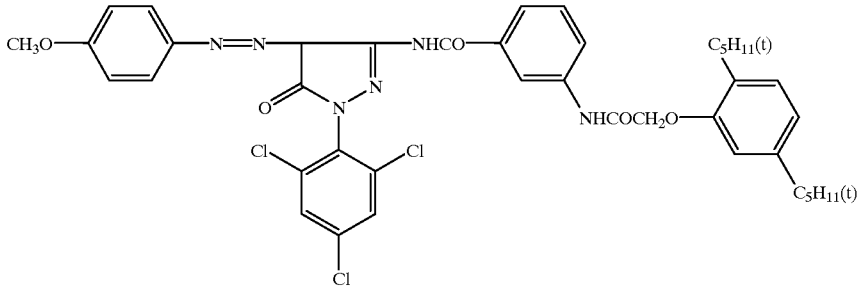
CM-2
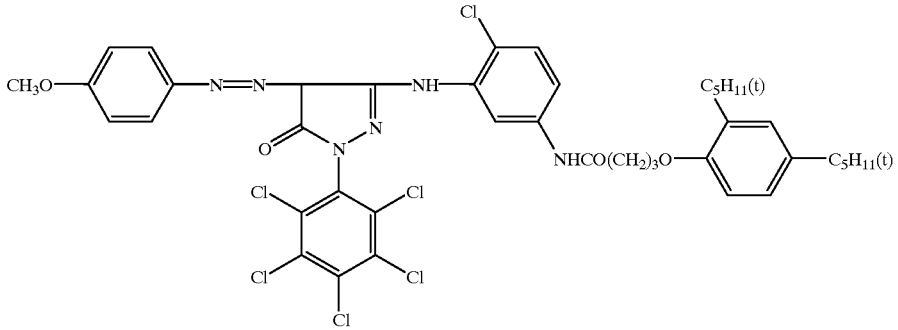
D-1
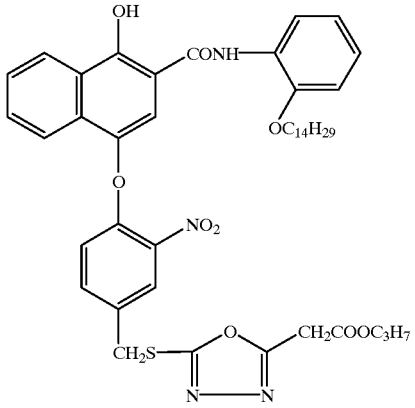
D-2
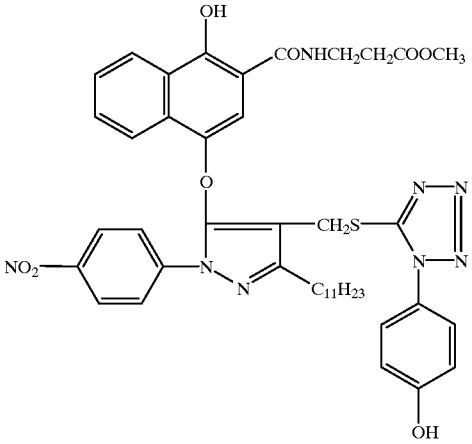
D-3
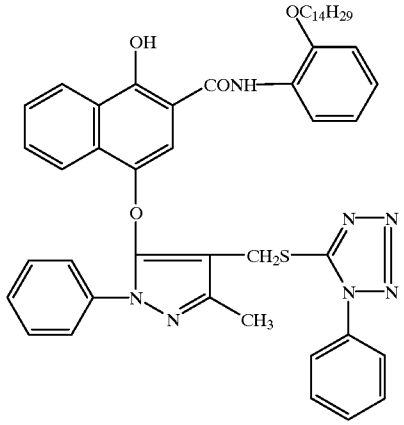
D-4
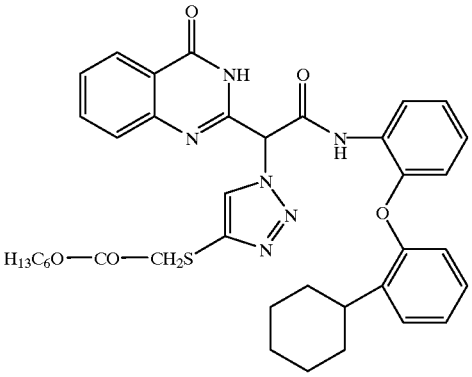

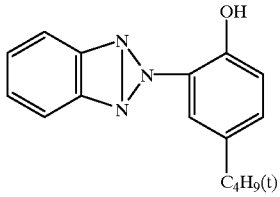
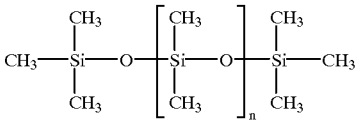
weight average molecular weight MW: 3,000
PM-1
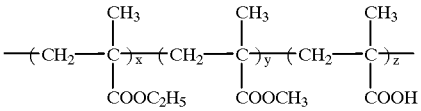
$x:y:z$ = 3:3:4
-continued
UV-11
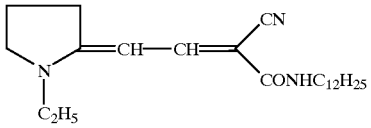
UV-12
WAX-1
-continued
V-1
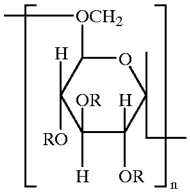
R:H, $SO_3H$
Weight average molecular weight MW: 120,000
SD-1
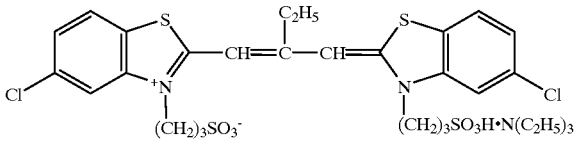
SD-2
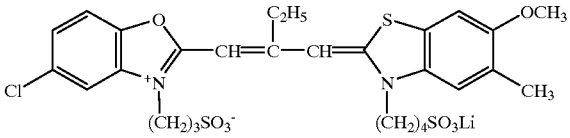
SD-3
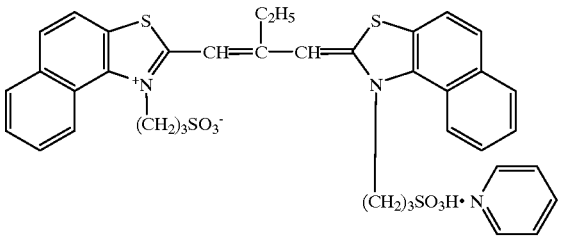
SD-4
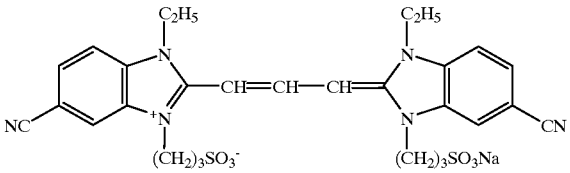
SD-5
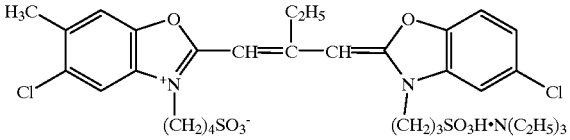

-continued

SD-6

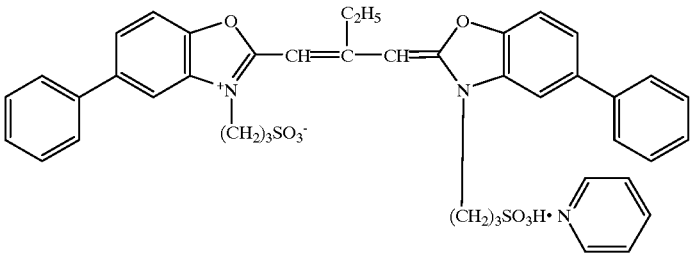

SD-7

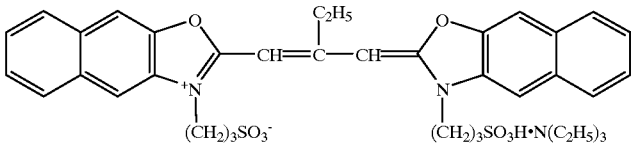

SD-8

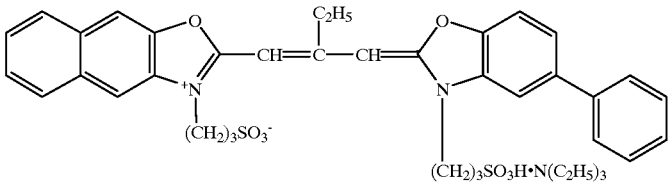

SD-9

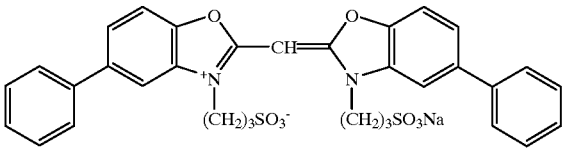

SD-10

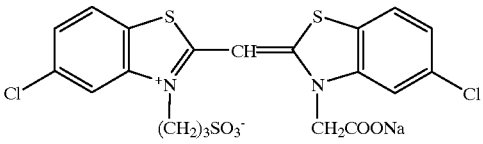

AI-11

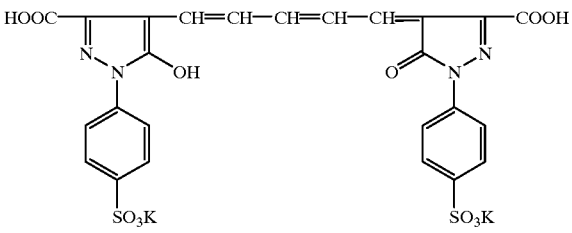

AI-12

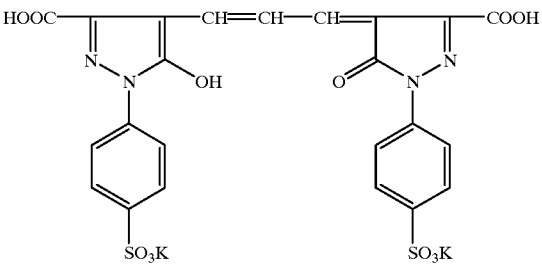

Next, in the same manner as in Sample 701 except that 0.3 g of the compound of the present invention per g of magenta coupler and compounds of the comparative sample (as shown in Table 9) were added to the silver halide emulsion layer of the 8th, 9th and 10th layer, Samples 702 through 716 were prepared.

Samples were subjected to wedge exposure to light for 1/200 seconds using a white light. Following this, evaluation on coloring property, sensitivity and bleaching fogging was conducted using those subjected to the following photographing processing A and B.

(Photographic processing A)

Color developing (3 min. and 15 sec.)→Bleaching (6 min. and 30 sec.)→Fixing (1 min. and 30 sec.)→Stabilizing (60 sec.)→Drying (60 sec.)

(Photographic processing B)

Color developing (3 min. and 15 sec.)→Bleaching (45 sec.)→Fixing (1 min. and 30 sec.)→Stabilizing (60 sec.)→Drying (60 sec.)

(Processing temperature in each processing step)

| Processing step | Processing temperature |
|---|---|
| Color developing | 38 ± 0.3° C. |
| Bleaching | 38 ± 2.0° C. |
| Fixing | 38 ± 2.0° C. |
| Stabilizing | 38 ± 5.0° C. |
| Drying | 55 ± 5.0° C. |

Formula of the processing solution used in each processing step were as follows: (provided that with regard to photographic processing A (ordinary processing), the processing solution in the bleaching step was the following bleaching solution A. With regard to photographic processing B (Process for magnifying bleach fogging), the processing solution in the bleaching process was the following bleaching solution B).

| Color developing solution | |
|---|---|
| Water | 800 cc |
| Potassium carbonate | 30 g |
| Sodium hydrocarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl) aniline sulfate | 4.5 g |
| Diethylenetetraamine pentaacetic acid | 3.0 g |
| Potassium hydroxide | 1.2 g |

Water was added to make 1 liter, and pH was regulated to 10.06 using potassium hydroxide or 20% sulfuric acid.

| Bleaching solution A | |
|---|---|
| Water | 700 cc |
| Ammonium ethylenediamine tetraacetic acid (III) | 130 g |
| Sodium nitrate | 40 g |
| Ammonium bromide | 150 g |
| Glacial acetic acid | 40 g |

Water was added to make 1 liter. pH was regulated to 6.2 using aqueous ammonia or glacial acetic acid.

| Bleaching solution B | |
|---|---|
| Water | 700 cc |
| ammonium of ferric (III) 1,3-diaminopropane tetraacetic acid | 125 g |
| Ethylenediamine tetraacetic acid | 2 g |
| Sodium nitrate | 40 g |
| Ammonium bromide | 150 g |
| Glacial acetic acid | 20 g |

Water was added to make 1 liter. Using an aqueous ammonia or glacial acetic acid, pH was regulated to 5.0 (the added amount of glacial acetic acid was halved. In addition, pH was also increased than ordinary one (4.4). Accordingly, bleaching fogging is easy to occur than actual situation.

| Fixing solution | |
|---|---|
| Water | 800 cc |
| Ammonium thiocyanate | 120 g |
| Ammonium thiosulfate | 150 g |
| Sodium sulfite | 15 g |
| Ethylenediamine tetraacetic acid | 2 g |

Water was added to make 1 liter, and pH was regulated to 6.2 using an aqueous ammonia or glacial acetic acid.

| Stabilizing solution | |
|---|---|
| Water | 900 cc |
| p-octylphenol.ethyleneoxide 10 mol additive | 2.0 g |
| Dimethylol urea | 0.5 g |
| Hexamethylenetetraamine | 0.2 g |

-continued

| Stabilizing solution | |
|---|---|
| 1,2-benzoisothiazoline-3-on | 0.1 g |
| Siloxane (L-77, produced by UCC) | 0.1 g |
| An aqueous ammonia | 0.5 cc |

Water was added to make 1 liter, and pH was regulated to 8.5 using an aqueous ammonia or 50% sulfuric acid.

<Coloring property>

In the above-mentioned processing step, the maximum density of the green sensitive emulsion layer of a dye image obtained using photographic processing A (ordinary processing) was measured using an optical densitometer (PDA-65, produced by Konica Corporation), and aforesaid maximum density was represented by a relative value when the maximum density of In the same manner as in coloring property, sensitivity was also represented by a relative value when the sensitivity of the Sample 701 was defined to be 100, after obtaining inverse of an exposure amount necessary for providing the minimum density+0.3 in the green sensitive emulsion layer of a dye image.

In the above-mentioned processing step, the bleach fogging value of each sample was defined by subtracting the fogging density value in the green sensitive emulsion layer when a sample was subjected to photographic processing A (ordinary processing) from the fogging density value in the green sensitive emulsion layer when the sample was subjected to photographic processing B (bleach fogging magnifying processing). Aforesaid bleach fogging value was compared by relative values when the bleach fogging of Sample 701 was defined to be 100. Namely, the smaller the value is, the larger the anti-bleach fogging effects is.

Table 9 shows the above-mentioned results.

TABLE 9

| Sample No. | Additive | Coloring Property | Sensitivity | Bleach-Fogging |
|---|---|---|---|---|
| 701 | — | 100 | 100 | 100 |
| 702 | Compound-1 of the Comparative sample | 76 | 95 | 34 |
| 703 | Compound-3 of the Comparative sample | 52 | 84 | 28 |
| 704 | Compound-10 of the Comparative sample | 88 | 97 | 44 |
| 705 | 92 | 114 | 106 | 33 |
| 706 | 93 | 112 | 101 | 36 |
| 707 | 98 | 112 | 104 | 35 |
| 708 | 103 | 110 | 101 | 38 |
| 709 | 120 | 101 | 102 | 38 |
| 710 | 127 | 107 | 101 | 36 |
| 711 | 110 | 107 | 102 | 41 |
| 712 | 113 | 104 | 100 | 40 |
| 713 | 137 | 101 | 100 | 42 |
| 714 | 143 | 104 | 104 | 39 |
| 715 | 95 | 102 | 103 | 38 |
| 716 | 118 | 103 | 100 | 38 |

Compound of the comparative sample-10

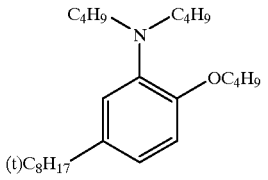

As is apparent from Table 9, samples of the present invention inhibit reduction of the coloring property and sensitivity. In addition, by adding the compound of the present invention, coloring property in increased. Further, effects to prevent anti-bleach fogging is found to be high.

According to the silver halide color photographic light-sensitive material of the present invention and a processing method of aforesaid light-sensitive material, a silver halide color photographic light-sensitive material wherein even in rapid and low replenishing processing, dye loss is improved, high coloring density can be obtained, a dye image formed is excellent in terms of light fastness and heat resistance and stain in uncolored portion is reduced and thereby there is no deterioration in coloring property of a coupler and stability of a dispersion solution including couplers could be provided.

What is claimed is:

1. A silver halide color photographic light-sensitive material comprising a silver halide light-sensitive layer provided on a support, wherein the silver halide light sensitive layer contains a non-coloring and water-insoluble compound represented by following Formula (V):

Formula (V)

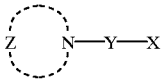

wherein X, which represents an electron attractive group having Hammett's substituent constant σp value of 0.25 or more, is selected from a group consisting of a nitro group, a cyano group, a carboxyl group, an acetyl group, a trifluoromethyl group, a trichloromethyl group, a benzoyl group, an acetyloxy group, a methanesulfonyl group, a methanesulfinyl group, a benzenesulfonyl group, a carbamoyl group, a methoxycarbonyl group, an ethoxycarbonyl group, a phenoxycarbonyl group, a methanesulfonyloxy group, a pyrazolyl group, a dimethoxyphosphoryl group,

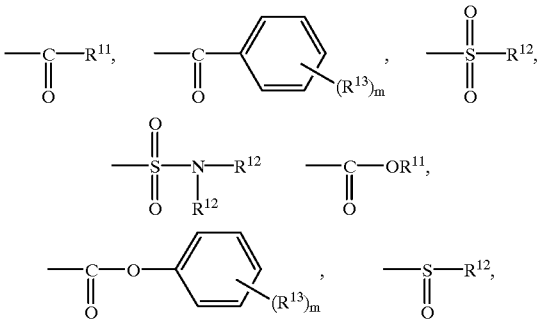

-continued

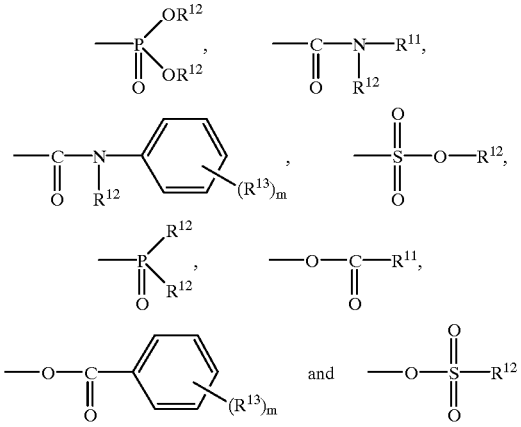

wherein $R^{11}$ represents a straight chained, branched or a cyclic alkyl group; $R^{12}$ represents a hydrogen atom, an aryl group or $R^{11}$; m represents an integer of 0 through 5; $R^{13}$ represents a nitro group, a cyano group, a hydroxyl group, an alkoxy group, an aryloxy group, an acyl group, an acyloxy group, an acylamino group, a sulfonamide group, a carbamoyl group, a sulfamoyl group, an sulfonyl group, an sulfinyl group, an alkoxycarbonyl group, an aryloxycarbonyl group, an sulfonyloxy group, a halogen atom, an aryl group, an alkylthio group, an arylthio group, an alkenyl group, or $R^{11}$; and the alkyl group represented by $R^{11}$ may be substituted by a substituent cited in $R^{13}$;

Y represents an alkylene group in which the number of carbon atoms in the main chain is 1 through 3; Z represents a non-metallic atom group necessary for forming a 5 to 7 member non-aromatic heterocycle together with the nitrogen atom shown in Formula V; and wherein when Z contains a second nitrogen atom and there is no nitrogen atom in Z more than two, the compound includes a substituent (—Y' —X') which is connected with the second nitrogen atom; where X' represents the group as defined as X, and Y' represents the group as defined as Y; X and X' and Y and Y' may be the same or different, provided that there is no basic amino group other than a basic skeleton of a non-aromatic heterocycle represented by

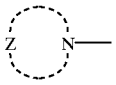

and the number of the carbon atoms in the molecule is 14 or more.

2. The silver halide color photographic light-sensitive material of claim 1 wherein X is

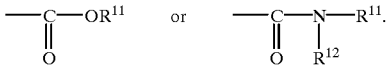

3. The silver halide color photographic light-sensitive material of claim 1 wherein the compound is represented by following Formulas (Va), (Vb), (Vc) or (Vd);

Formula (Va)

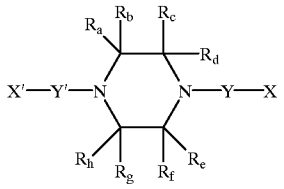

Formula (Vb)

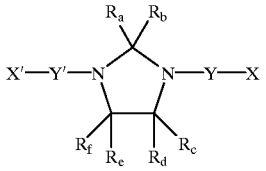

Formula (Vc)

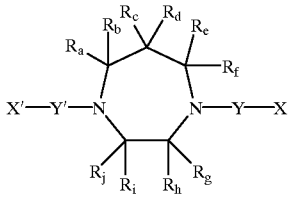

$X^1$ represents the group as defined as X, and Y' represents the group as defined as Y; X and X' and Y and Y' may be the same or different; Ra, Rb, Rc, Rd, Re, Rf, Rg, Rh, Ri, and Rj independently represents a hydrogen atom or an alkyl group, Formula (Vd)

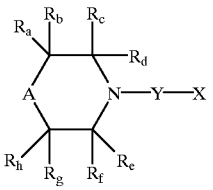

wherein A represents an oxygen atom, a sulfur atom or a methylene group; each of Ra, Rb, Rc, Rd, Re, Rf, Rg and Rh independently represents a hydrogen atom or an alkyl group.

4. The silver halide color photographic light-sensitive material of claim 3 wherein the compound is represented by following Formulas (Va-1), (Vd-1) or (Vd-2), Formula (Va-1)

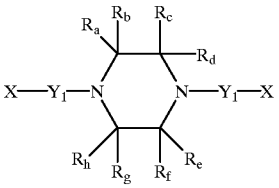

wherein the number of carbon atoms in X and $Y_1$ is 12 or more,

Formula (Vd-1)

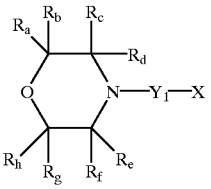

wherein the total number of carbon atoms in X and $Y_1$ is 12 or more,

Formula (Vd-2)

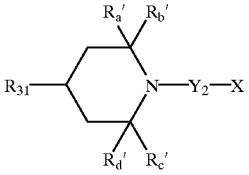

wherein each of Ra', Rb', Rc' and Rd' independently represents an alkyl group; $R_{31}$ is an acyloxy group, an acylamino group, a hydroxyl group or an alkyl group; and the total number of the carbon atoms of X, $Y_2$, $R_2$, $R_{31}$, Ra', Rb', Rc' and Rd' is 12 or more.

5. The silver halide color photographic light-sensitive material of claim 3 wherein the compound is represented by the following Formulas (Va-2):

Formula (Va-2)

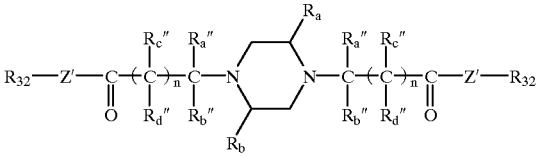

wherein each of Ra, Rb, Ra", Rb", Rc" and Rd" independently represents a hydrogen atom or alkyl group; Z' represents —O— or —N($R_{33}$)—; $R_{32}$ represents an alkyl group or an aryl group; $R_{33}$ represents a hydrogen atom, an alkyl group or an aryl group; n represents 0 or 1; and the total number of carbon atoms of Ra, Rb, Ra", Rb", Rc", Rd", $R_{32}$ and $R_{33}$ is 20 or more.

6. A silver halide photographic light-sensitive material comprising a silver halide light-sensitive layer provided on a support, wherein the silver halide light-sensitive layer contains a non-coloring and water insoluble compound represented by following Formula (V);

Formula (V)

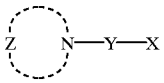

wherein X, which represents an electron attractive group having Hammett's substituent constant up value of 0.25 or more, is selected from a group consisting of a nitro group, a cyano group, a carboxyl group, an acetyl group, a trifluoromethyl group, a trichloromethyl group, a benzoyl group, an acetyloxy group, a methanesulfonyl group, a methanesulfinyl group, a benzenesulfonyl group, a carbamoyl group, a methoxycarbonyl group, an ethoxycarbonyl group, a phenoxycarbonyl group, a methanesulfonyloxy group, a pyrazolyl group, a dimethoxyphosphoryl group,

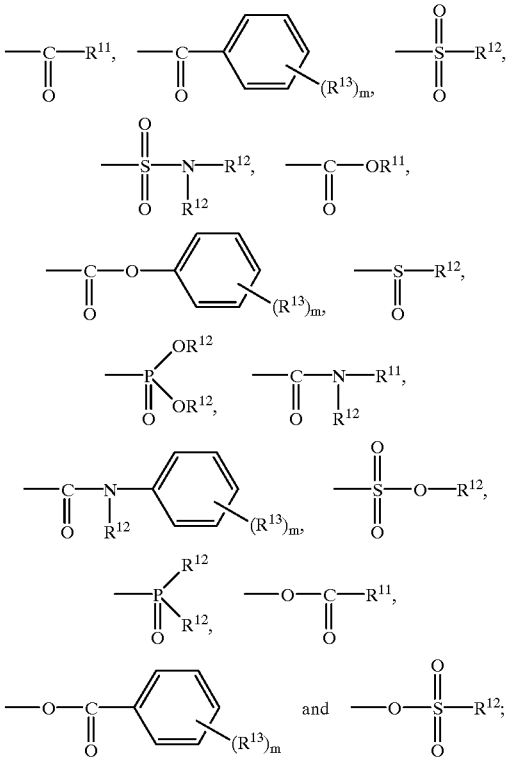

wherein $R^{11}$ represents a straight chained, branched or a cyclic alkyl group; $R^{12}$ represents a hydrogen atom, an aryl group or $R^{11}$; m represents an integer of 0 through 5; $R^{13}$ represents a nitro group, a cyano group, a hydroxyl group, an alkoxy group, an aryloxy group, an acyl group, an acyloxy group, an acylamino group, a sulfonamide group, a carbamoyl group, a sulfamoyl group, an sulfonyl group, an sulfinyl group, an alkoxycarbonyl group, an aryloxycarbonyl group, an sulfonyloxy group, a halogen atom, an aryl group, an alkylthio group, an arylthio group, an alkenyl group, or $R^{11}$; and the alkyl group represented by $R^{11}$ may be substituted by a substituent cited in $R^{13}$;

Y represents an alkylene group in which the number of carbon atoms in the main chain is 1 through 3; Z represents a non-metallic atom group necessary for forming a 5 to 7 member non-aromatic heterocycle together with the nitrogen atom in Formula V; and wherein when Z contains a second nitrogen atom and there is no nitrogen atom in Z more than two, the compound includes a substituent (—Y' —X') which is connected with the second nitrogen atom; where X' represents the group as defined as X, and Y' represents the group as defined as Y; X and X' and Y and Y' may be the same or different, provided that there is no basic amino group other than a basic skeleton of a non-aromatic heterocycle represented by

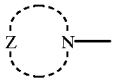

and the number of carbon atoms in the molecule is 14 or more.

7. The silver halide photographic light-sensitive material of claim 6 wherein X is

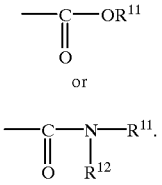

8. The silver halide photographic light-sensitive material of claim 6 wherein the compound is represented by following Formulas (Va), (Vb), (Vc), or (Vd);

Formula (Va)

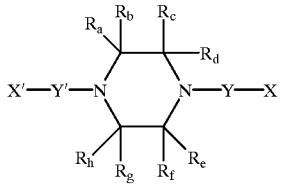

Formula (Vb)

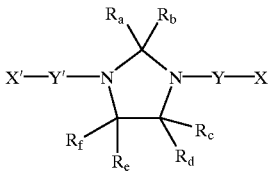

Formula (Vc)

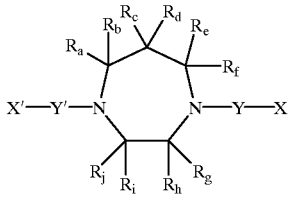

wherein X' is the same as X and Y' is the same as defined as Y; X and X' and Y and Y' may be the same or different; each of Ra, Rb, Rc, Rd, Re, Rf, Rg, Rh, Ri, and Rj independently represents a hydrogen atom or an alkyl group, Formula (Vd)

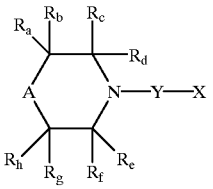

wherein A represents an oxygen atom, a sulfur atom or a methylene group; each of Ra, Rb, Rc, Rd, Re, Rf, Rg and Rh independently represents a hydrogen atom or an alkyl group.

9. The silver halide photographic light-sensitive material of claim 8 wherein the compound is represented by following Formulas (Va-1), (Vd-1), or (Vd-2), Formula (Va-1)

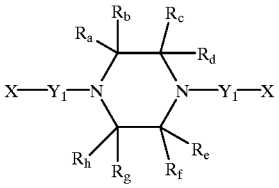

wherein the number of carbon atoms in X and $Y_1$ is 12 or more,

Formula (Vd-1)

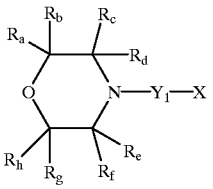

wherein the total number of carbon atoms in X and $Y_1$ is 12 or more,

Formula (Vd-2)

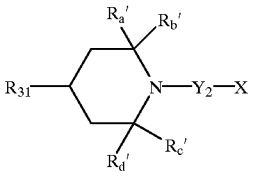

wherein each of Ra', Rb', Rc' and Rd' independently represents an alkyl group, $R_3$, is an acyloxyl group, an acylamino group, a hydroxyl group or an alkyl group; and the total number of the carbon atoms of X, $Y_2$, $R_{31}$, Ra', Rb', Rc' and Rd' is 12 or more.

10. The silver halide color photographic light-sensitive material of claim 8 wherein the compound is represented by the following Formulas (Va-2):

Formula (Va-2)

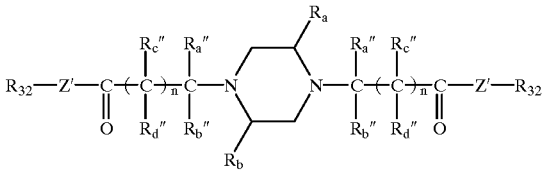

wherein each of Ra, Rb, Ra", Rb", Rc" and Rd" independently represents a hydrogen atom, or alkyl group; Z' represents —O— or —N($R_{33}$)—; $R_{32}$ represents an alkyl group or an aryl group; $R_{33}$ is a hydrogen atom, an alkyl group, or an aryl group; n is 0 or 1; and the total number of carbon atoms of Ra, Rb, Ra", Rb", Rc", Rd", $R_{32}$ and $R_{33}$ is 20 or more.

11. A silver halide color photographic light-sensitive material comprising a silver halide light-sensitive layer provided on a support, wherein the silver halide light-sensitive layer contains a compound represented by following Formula (V):

Formula (V)

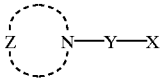

wherein X which represents an electron attractive group having Hammett's substituent constant σp value of 0.25 or more, is selected group a group consisting of a nitro group, a cyano group, a carboxyl group, an acetyl group, a trifluoromethyl group, a trichloromethyl group, a benzoyl group, an acetyloxy group, a methanesulfonyl group, a methanesulfinyl group, a benzenesulfonyl group, a carbamoyl group, a methoxycarbonyl group, an ethoxycarbonyl group, a phenoxycarbonyl group, a methanesulfonyloxy group, a pyrazolyl group, a dimethoxyphosphoryl group,

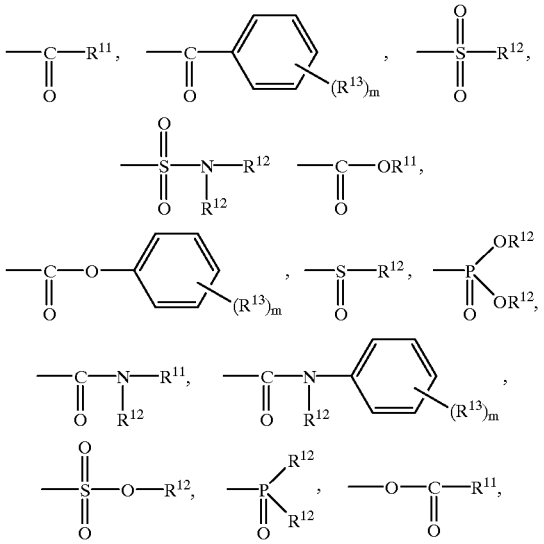

-continued

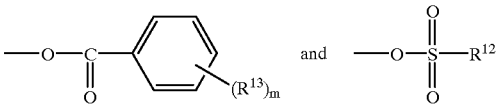

wherein $R^{11}$ represents a straight chained, branched or a cyclic alkyl group; $R^{12}$ represents a hydrogen atom, an aryl group or $R^{11}$; m represents an integer of 0 through 5; $R^{13}$ represents a nitro group, a cyano group, a hydroxyl group, an alkoxy group, an aryloxy group, an acyl group, an acyloxy group, an acylamino group, a sulfonamide group, a carbamoyl group, a sulfamoyl group, an sulfonyl group, an sulfinyl group, an alkoxycarbonyl group, an aryloxycarbonyl group, an sulfonyloxy group, a halogen atom, an aryl group, an alkylthio group, an arylthio group, an alkenyl group, or $R^{11}$; and the alkyl group represented by $R^{11}$ may be substituted by a substituent cited in $R^{13}$;

Y represents an alkylene group in which the number of carbon atoms in the main chain is 1 through 3; Z represents a non-metallic atom group necessary for forming a 5 to 7 member non-aromatic heterocycle together with the nitrogen atom in Formula V; and wherein when Z contains a second nitrogen atom and there is no nitrogen atom in Z more than two, the compound includes a substituent (—Y' —X') which is connected with the second nitrogen atom; where X' represents the group as defined as X, and Y' represents the group as defined as Y; X and X' and Y and Y' may be the same or different, provided that there is no basic amino group other than a basic skeleton of a non-aromatic heterocycle represented by

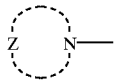

and the number of carbon atoms in the molecule is 14 or more.

12. The silver halide color photographic light-sensitive material of claim 11 wherein X is

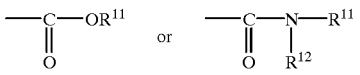

13. The silver halide color photographic light-sensitive material of claim 11 wherein the compound is represented by following Formulas (Va), (Vb), (Vc) or (Vd);

Formula (Va)

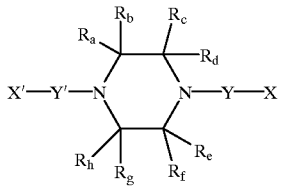

Formula (Vb)

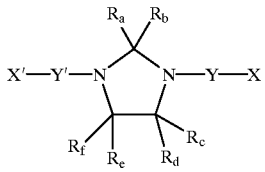

Formula (Vc)

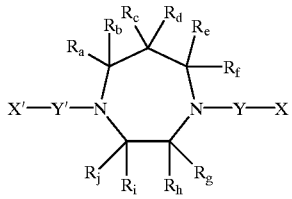

wherein X' is the same as X and Y' is the same as Y; X and X' and Y and Y' may be the same or different; each of Ra, Rb, Rc, Rd, Re, Rf, Rg, Rh, Ri, and Rj independently represents a hydrogen atom or an alkyl group, Formula (Vd)

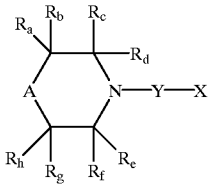

wherein A represents an oxygen atom, a sulfur atom or a methylene group; each of Ra, Rb, Rc, Rd, Re, Rf, Rg and Rh independently represents a hydrogen atom or an alkyl group.

14. The silver halide color photographic light-sensitive material of claim 13 wherein the compound is represented by following Formulas (Va-1), (Vd-1) or (Vd-2), Formula (Va-1)

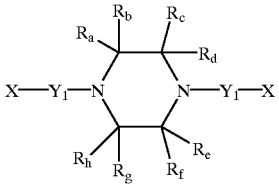

wherein the number of the carbon atoms in X and $Y_1$ is 12 or more,

Formula (Vd-1)

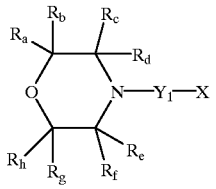

wherein the number of the carbon atoms in X and $Y_1$ is 12 or more,

Formula (Vd-2)

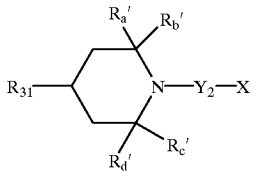

wherein each of Ra', Rb', Rc' and Rd' independently represents an alkyl group; $R_{31}$, represents an acyloxy group, an acylamino group, a hydroxyl group or an alkyl group; and the total number of the carbon atoms of X, $Y_2$, $R_{31}$, Ra', Rb', Rc' and Rd' is 12 or more.

15. The silver halide color photographic light-sensitive material of claim 13 wherein the compound is represented by the following Formulas (Va-2):

Formula (Va-2)

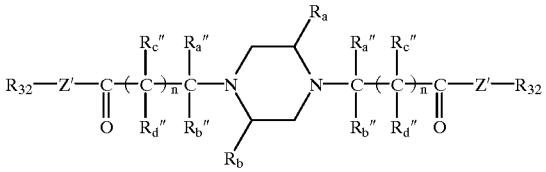

wherein each of Ra, Rb, Ra", Rb", Rc" and Rd" independently represents a hydrogen atom, or alkyl group; Z' represents —O— or —N($R_{33}$)—; $R_{32}$ represents an alkyl group, an aryl group; $R_{33}$ represents a hydrogen atom, an alkyl group or an aryl group; n represents 0 or 1; and the total number of the carbon atoms of Ra, Rb, Ra", Rb", Rc", Rd", $R_{32}$ and $R_{33}$ is 20 or more.

* * * * *